US009792796B1

(12) United States Patent
Lauka et al.

(10) Patent No.: US 9,792,796 B1
(45) Date of Patent: Oct. 17, 2017

(54) MONITORING SAFETY COMPLIANCE BASED ON RFID SIGNALS

(71) Applicant: Amazon Technologies, Inc., Reno, NV (US)

(72) Inventors: Wesley Scott Lauka, Seattle, WA (US); Fransisca Vina Zerlina, Seattle, WA (US); Jamie Maria Holland, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 490 days.

(21) Appl. No.: 14/314,520

(22) Filed: Jun. 25, 2014

(51) Int. Cl.
*G08B 23/00* (2006.01)
*G08B 21/02* (2006.01)

(52) U.S. Cl.
CPC ..... *G08B 21/02* (2013.01)

(58) Field of Classification Search
CPC ..... G08B 21/02; B66B 29/08; B66B 31/00
USPC ..... 340/573.1
See application file for complete search history.

(56) References Cited

U.S. PATENT DOCUMENTS 5,099,977 A * 3/1992 Hirose ..... B66B 23/02 198/323
6,366,242 B1 4/2002 Boyd et al.
6,531,964 B1 3/2003 Loving
8,169,303 B2 5/2012 Hanebeck
8,482,412 B2 7/2013 Majoros et al.
8,542,834 B1 9/2013 Feikis et al.
8,556,178 B2 10/2013 Wang et al.
8,893,969 B2 11/2014 Brandl
9,405,948 B2 8/2016 Schwiers et al.
2002/0067264 A1 6/2002 Soehnlen
2002/0185542 A1 * 12/2002 Wilz, Sr. ..... G06K 7/10693 235/462.46
2003/0075608 A1 4/2003 Atherton
2003/0136635 A1 * 7/2003 Lauch ..... B66B 29/005 198/335
2003/0189493 A1 * 10/2003 Klausner ..... B62D 15/029 340/575

(Continued)

FOREIGN PATENT DOCUMENTS

WO 2014093968 A1 6/2014

OTHER PUBLICATIONS

International Search Report and Written Opinion of PCT Application No. PCT/US2015/037287 with a mailing date of Sep. 30, 2015.

(Continued)

*Primary Examiner* — Zhen Y Wu
(74) *Attorney, Agent, or Firm* — Athorus, PLLC

(57) ABSTRACT

Where a safety requirement mandates contact with a grippable structural element such as a handle, a handrail, a handlebar or a steering wheel, compliance with the requirement may be determined using one or more manually activated RFID tags provided in designated locations on the grippable structural element. A level of compliance with the requirement during a given activity may be determined based at least in part on the number of RFID signals received from the manually activated RFID tags, which may be compared to a number of workers engaged in the given activity. Based on the level of compliance, relevant feedback in the form of electronic messages, signals or sounds may be identified and provided to one or more of the workers.

19 Claims, 11 Drawing Sheets

(56) References Cited

U.S. PATENT DOCUMENTS

2004/0066296 A1 4/2004 Atherton
2004/0119605 A1 6/2004 Schaper
2005/0183990 A1 8/2005 Corbett
2005/0200476 A1 9/2005 Forr et al.
2005/0203798 A1 9/2005 Jensen et al.
2005/0234774 A1 10/2005 Dupree
2005/0243784 A1 11/2005 Fitzgerald et al.
2005/0284941 A1 12/2005 Lubow
2006/0119481 A1 6/2006 Tethrake et al.
2006/0145880 A1 7/2006 Chi et al.
2006/0186201 A1 8/2006 Hart
2006/0284839 A1* 12/2006 Breed ..... B62D 1/046 345/156
2007/0018832 A1 1/2007 Beigel et al.
2007/0021197 A1 1/2007 Frerking
2007/0030151 A1 2/2007 Morrow
2007/0057469 A1 3/2007 Grauzer et al.
2007/0075148 A1* 4/2007 Usami ..... G06K 19/0716 235/492
2007/0075861 A1 4/2007 Cook et al.
2007/0096906 A1 5/2007 Lyons et al.
2007/0109101 A1 5/2007 Colby
2007/0126578 A1 6/2007 Broussard
2007/0136218 A1 6/2007 Bauer et al.
2007/0152829 A1 7/2007 Lindsay et al.
2007/0164863 A1 7/2007 Himberger et al.
2007/0175972 A1 8/2007 Ringer
2007/0296599 A1 12/2007 Wang et al.
2008/0093176 A1* 4/2008 Rosenthal ..... B66B 9/083 187/241
2008/0113767 A1 5/2008 Nguyen et al.
2008/0185265 A1* 8/2008 Gonzalez Alemany ..... B66B 29/04 198/338
2009/0033463 A1 2/2009 Posamentier
2009/0085721 A1 4/2009 Dishongh
2009/0167699 A1 7/2009 Rosenblatt et al.
2009/0309086 A1* 12/2009 Behan ..... B66B 29/005 256/59
2010/0063652 A1 3/2010 Anderson
2010/0097195 A1 4/2010 Majoros et al.
2010/0114426 A1 5/2010 Boss et al.
2010/0123581 A1 5/2010 Hatfield et al.
2010/0171592 A1 7/2010 Kamemaru
2010/0177993 A1 7/2010 Chen
2010/0271187 A1* 10/2010 Uysal ..... G06K 7/0008 340/10.4
2010/0308964 A1 12/2010 Ackley et al.
2010/0308975 A1 12/2010 Gregersen et al.
2011/0163850 A1 7/2011 Bachman et al.
2011/0227748 A1 9/2011 Schaible et al.
2011/0266342 A1 11/2011 Forster
2011/0285507 A1 11/2011 Nelson
2013/0314207 A1* 11/2013 Yonekura ..... G06K 7/10366 340/5.8
2013/0342349 A1* 12/2013 Cruz ..... G08B 21/245 340/573.1
2014/0002113 A1* 1/2014 Schediwy ..... G06F 3/044 324/661
2014/0012161 A1* 1/2014 Ross, Jr. ..... A41D 27/10 600/595
2014/0061303 A1 3/2014 Brandl
2014/0061382 A1 3/2014 Tucker
2014/0111333 A1* 4/2014 Haas ..... G08B 23/00 340/539.11
2014/0121903 A1* 5/2014 Lee ..... B60K 35/00 701/41
2014/0148988 A1* 5/2014 Lathrop ..... B60W 50/10 701/23
2014/0176307 A1 6/2014 Forster
2014/0186219 A1* 7/2014 Yukimoto ..... A61L 2/26 422/105
2014/0232519 A1 8/2014 Allen et al.
2015/0357948 A1 12/2015 Goldstein
2015/0360567 A1* 12/2015 Sannomiya ..... G06F 3/04883 345/174

OTHER PUBLICATIONS

International Search Report and Written Opinion of PCT Application No. PCT/US2015/056779 with a mailing date of Jan. 19, 2016.
"A Capacitive Touch Interface for Passive RFID Tags," Sample, A.P., Yeager, D.J., and Smith, J.R. 2009 IEEE International Conference on RFID, pp. 103-109.
International Search Report for International Application No. PCT 2015/037531 mailed Sep. 25, 2015.

* cited by examiner

MONITORING SAFETY COMPLIANCE BASED ON RFID SIGNALS

BACKGROUND

Maximizing worker safety in an industrial or commercial environment is a challenging task of paramount importance. Business organizations regularly provide safety manuals, post instructions and make training aids available to their workers, while also offering numerous hours of training to emphasize the importance of adhering to established protocols and procedures with a goal of ensuring the safety of all workers.

An organization may not simply rely on the fact that training has occurred in order to ensure that requirements, standards or regulations will be adhered to, or that the safety of all workers may be ensured. Rather, the organization must implement one or more compliance monitoring systems or processes in order to determine a level of compliance with any relevant requirements, standards or regulations.

Within an industrial or commercial environment, workers who perform potentially dangerous tasks or activities are typically instructed to maintain positive, manual control over themselves or their equipment during such tasks or activities. Frequently, the workers are instructed to manually grasp one or more handrails, handles, bars or rings that may be provided in association with one or more structural elements, such as ladders or sets of stairs, or on one or more tools, utensils or other like apparatuses. For example, a worker who is climbing a set of stairs is often trained to hold onto at least one handrail while in transit, in order to maximize the safety not only of the worker but also of any other workers traveling ahead of or behind the worker. Likewise, a worker who is operating a powered machine or carrying a heavy object is frequently instructed to grip the powered machine in a particular manner or to place his or her hands in a specific location beneath the heavy object. Where a safety requirement is predicated on proper manual contact, however, determining compliance with the safety requirement is often difficult. Moreover, a worker's failure to act in accordance with such a safety requirement often does not manifest itself until the worker has already injured himself or others on account of his or her failure.

DETAILED DESCRIPTION

As is set forth in greater detail below, the present disclosure is directed to monitoring safety compliance based on one or more signals received from one or more manually activated radio frequency identification (or "RFID") tags or sources associated with various entities, e.g., objects, humans, machines or structures, in an active or working environment. Specifically, the systems and methods disclosed herein are directed to making determinations as to whether a safety rule or regulation is being complied with based at least in part on information regarding signals received from a manually activated RFID tag applied to grippable structural elements such as handles, hand rails or handle bars that may be grasped and/or manipulated by one or more workers. Using such information, and any other relevant information that may be used to identify the workers, or an event, activity or circumstance associated with the workers, an appropriate type and form of feedback (e.g., helpful praise or constructive criticism) may be identified for the workers, and provided in any format, such as audio, video or multimedia signals, or any other electronic messages, as well as ambient lights or sounds presented to one or more of the recipients.

Figure 1:
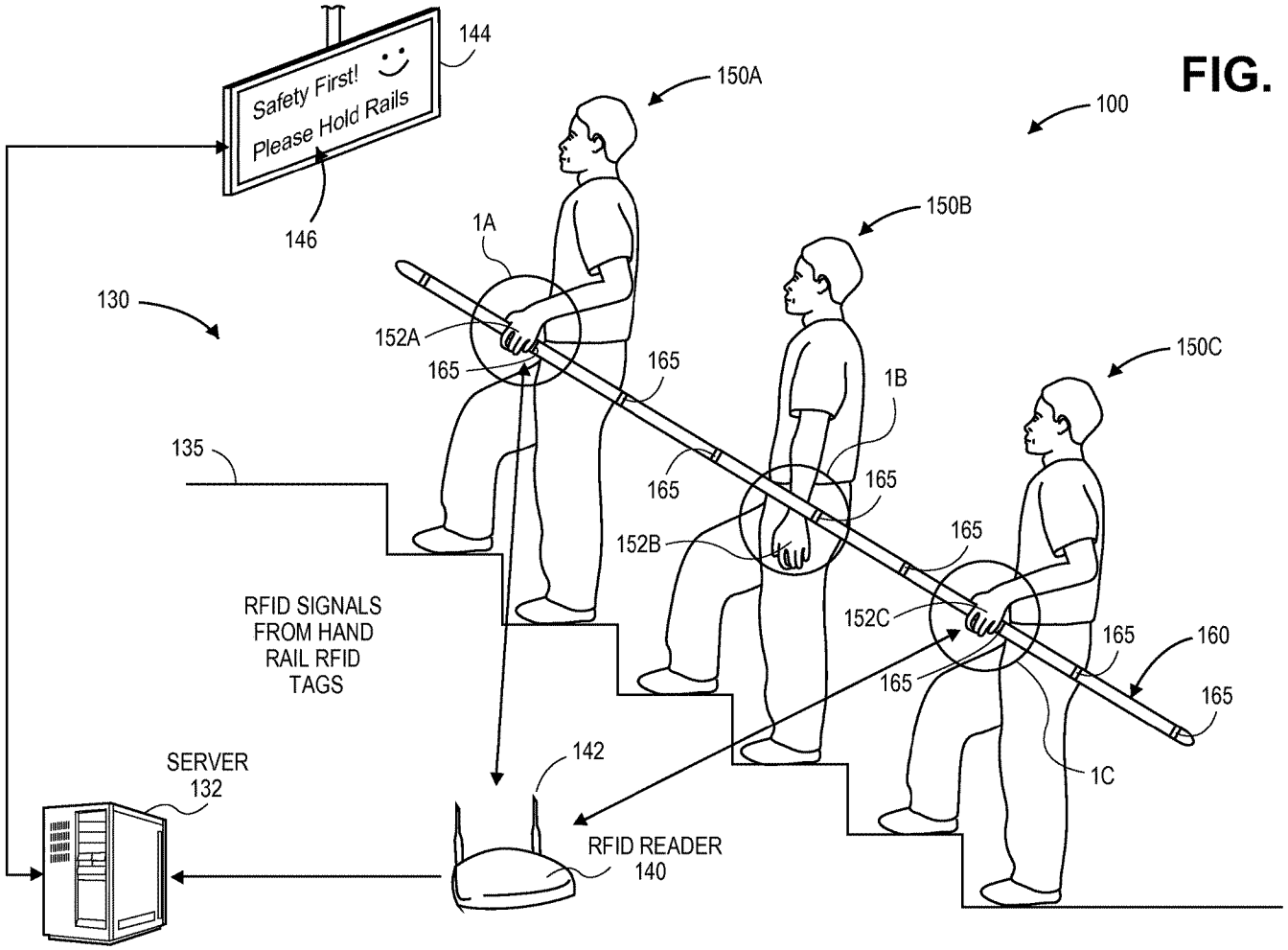
FIG. 1 is a view of one system for monitoring safety compliance based on RFID signals, in accordance with embodiments of the present disclosure.

Referring to FIG. 1, one system 100 for monitoring safety compliance based on RFID signals is shown. The system 100 of FIG. 1 includes an industrial facility 130 having a computer server 132 and a set of stairs 135. The system 100 further includes an RFID reader 140 having an antenna 142, a safety monitor display 144 and a handrail 160. The system 100 also includes a plurality of workers 150A, 150B, 150C traveling up the set of stairs 135, as well as a plurality of banded manually activated RFID tags 165 at spaced intervals on the handrail 160.

As is shown in FIG. 1, when one of the workers 150A, 150B, 150C makes contact with one or more of the banded manually activated RFID tags 165, an RFID signal is transmitted to the RFID reader 140 from each of the banded manually activated RFID tags 165 with which one of the workers 150A, 150B, 150C made contact. For example, as is shown at 1A, the worker 150A grips one of the banded manually activated RFID tags 165 with a hand 152A, and an RFID signal is transmitted from the banded manually activated RFID tag 165 gripped by the hand 152A of the worker 150A to the RFID reader 140. Similarly, as is shown at 1C, the worker 150C grips one of the banded manually activated RFID tags 165 with a hand 152C, and an RFID signal is transmitted from the banded manually activated RFID tag 165 gripped by the hand 152C of the worker 150C to the RFID reader 140. However, as is shown at 1B, because the worker 150B has not gripped any of the banded manually activated RFID tags 165 with a hand 152B, no such signals are transmitted from any of the banded manually activated RFID tags 165 in a vicinity of the worker 150B.

Moreover, as is also shown in FIG. 1, information regarding the RFID signals received from the manually activated RFID tags 165 contacted by the worker 150A and the worker 150C may be transmitted from the RFID reader 140 to the safety monitor display 144 or another feedback device for providing feedback, such as a safety reminder message 146, to the workers 150A, 150B, 150C.

Accordingly, by strategically providing RFID tags in association with a safety requirement, e.g., an obligation to hold a handrail on a stairway, or any other rule or standard requiring manual contact with a structural or grippable element, the systems and methods of the present disclosure may make a determination as to an extent to which one or more workers is complying with the safety requirement. Based at least in part on the determination, the systems and methods disclosed herein may provide any type of feedback, including but not limited to words of encouragement or symbols of warning, to one or more workers and in any manner. Moreover, the systems and methods disclosed herein may further utilize one or more means for identifying particular workers, including signals received from RFID tags associated with such workers, or any other identifying information that may be available regarding such workers, and may correlate information regarding compliance with a safety requirement with one or more individual workers. In this regard, specifically tailored feedback may be identified and provided to such workers either in hindsight after the workers have performed a task, or upon identifying the workers prior to their performance of the task.

In many industrial and commercial environments, maintaining safety is critically important. Vigilance and adherence to established safety standards may not only protect the well-being of workers within such environments but also create a shared sense of security and define the limits of proper bounded behavior among such workers. Maintaining a safe working environment is accomplished most effectively when workers know and understand their relevant and applicable safety requirements, and are aware of their own expected conduct in relation to such requirements, as well as the expected conduct of others.

One example of a working environment having a predefined safety standard is a staircase or other set of stairs. In most industrial or commercial facilities, such as a fulfillment center associated with an online marketplace, workers who climb or descend stairs when traveling from one level to another are at least expected, if not required, to grasp or hold onto at least one handrail. Such a requirement can provide a number of safety advantages including an additional point of balance or support for a worker in the event of a trip or fall, which may impact not only the worker who tripped or fell but also other workers traveling ahead or behind the worker, and may also enact a considerable human or economic cost. While a requirement to grasp or hold a handrail while traveling up or down stairs is commonly understood in the abstract, grasping or holding a handrail may be easily forgotten or overlooked when a worker is in a rush, when the worker is carrying one or more objects, or when the worker is otherwise preoccupied.

RFID refers to a wireless, non-contacting system for transferring data by way of radio frequency electromagnetic fields. In an RFID system, data transfers occur in the form of modulated signals transmitted between an RFID tag (or an RFID device), which may include various communication components, logic or circuitry, and an RFID reader, which may include antennas or other like devices. Data stored within a microchip or other storage device associated with the RFID tag may be sent to the RFID reader, which may interpret not only the data received in the RFID signal but also other relevant information or attributes of the RFID signal, such as an intensity or a frequency of the RFID signal, as well as a direction from which the RFID signal originated, a range traveled by the RFID signal or at least some of the information or data included in the RFID signal. The transfer of the RFID signal is initiated when an electric field or a magnetic field transmitted by an RFID reader is sensed by an RFID tag, which transmits information or data that may be stored in association with the RFID tag in one or more microchips or other storage devices.

RFID systems provide a number of advantages over similar systems for the short-range transfer of information or data. First, an RFID tag may be formed of components having remarkably small, compact shapes and sizes, and tags that are as thin as a sheet of paper or smaller than a grain of rice are quite common. Additionally, unlike a bar code (e.g., a one-dimensional bar code or a two-dimensional "QR" code), an RFID tag need not be provided within a line of sight of an RFID reader in order to successfully transmit data. Therefore, RFID tags may be concealed or embedded into many different types of objects of any size or shape, as well as humans or other animals. Next, an RFID tag may be programmed with a fixed set or packet of "read-only" data which may be transmitted to an RFID reader countless number of times in theory, or reprogrammed with modifiable sets of data that may be written and rewritten, as needed, based on the application in which the RFID tag is provided. Moreover, and perhaps most importantly, while an active RFID tag includes and utilizes a local power source, such as a battery, a passive RFID tag does not require any power in order to successfully transmit a set or packet of data to an RFID reader, and may therefore transmit such data when power supplies are unavailable or in environments where providing power to the RFID tag is infeasible.

RFID signals may be transmitted from an RFID tag to an RFID reader in many different formats and at many different frequency levels. An RFID tag that transmits signals within low frequency (LF), medium frequency (MF) or high frequency (HF) levels (e.g., approximately 3 kilohertz to 30 megahertz, or 3 kHz-30 MHz) may transfer relatively small-sized sets or packets of data over short ranges (e.g., between one and one hundred centimeters, or 1-100 cm). Other RFID tags may transmit signals at higher frequency levels, such as ultrahigh frequency (UHF) or microwave levels (e.g., approximately 300 megahertz to 300 gigahertz, or 300 MHz-300 GHz) including larger sets or packets of data at ranges of one meter (1 m) or longer.

A signal transmission from an RFID tag to an RFID reader may be achieved in any number of ways. An inductively coupled RFID tag is an RFID tag that is powered by energy obtained from magnetic fields generated by an RFID reader, and may be coupled to the RFID reader using this energy. In this regard, an RFID reader may include one or more coils through which an electric current may pass, thereby causing a magnetic field to be generated by the RFID reader according to Ampere's Law. Likewise, an inductively coupled RFID tag may also include one or more coils. When the RFID tag passes within a particular range of the RFID reader, an electric current is generated within the coils of the RFID tag, thereby coupling the RFID reader and the RFID tag based on the magnetic flux passing through the respective sets of coils. The electric current passing through the coils of the RFID tag may then power internal circuits within the RFID tag, and cause an RFID signal to be transmitted from the RFID tag to the RFID reader accordingly. Thus, inductively coupled RFID tags are commonly used in powerless environments where a passive system for transmitting signals may be required.

Additionally, an RFID tag may be coupled by any number of other modes. For example, capacitively coupled RFID tags include coupling plates that are designed to correspond to a plate of an RFID reader. When the RFID tag is placed in sufficiently close proximity to the RFID reader, thereby causing the corresponding coupling plates of the RFID tag and the RFID reader to be aligned in parallel with one another and within a short range, a transfer of data from the RFID tag to the RFID reader is achieved. Unlike an inductively coupled RFID tag, which is powered by a magnetic field generated by an RFID reader, a capacitively coupled RFID tag is powered by an alternating electric field generated by an RFID reader. For this reason, capacitively coupled RFID tags usually have more limited operating ranges than inductively coupled RFID tags and are typically employed in near-field communication environments. Similarly, a backscatter-coupled RFID tag receives power emitted from an RFID reader's antenna. A portion of the emissions from the RFID reader are received by a corresponding antenna of the RFID tag and may be filtered or rectified, as necessary, in order to trigger a transfer of data from the RFID tag to the RFID reader. Any type or mode of coupling between an active, semi-active (e.g., powered on a temporary basis or for limited purposes) or passive RFID tag and an RFID reader may be utilized in accordance with the present disclosure.

In addition to RFID tags which are automatically coupled with an RFID reader, the systems and methods of the present disclosure may further include an RFID tag, such as a passive RFID tag, which may be manually activated, e.g., coupled upon a manual action, by a human or machine in order to cause a transmission of a data signal from the RFID tag to one or more RFID readers. A manually activated RFID tag may include physical or virtual switches that may close a circuit within the RFID tag and thereby permit the RFID tag to function as a data transmitter in the presence of an electric or magnetic field. For example, a manually activated RFID tag may include capacitive elements that define a capacitor within the RFID tag, and may effectively close a circuit within the RFID tag when such elements detect bioelectricity from a user. The term "bioelectricity" generally refers to electrical charges or electric field gradients that may be stored within a living body, such as a human body, which contains blood and other matter having a variety of positively and negatively charged ions (e.g., sodium, chloride and others). Bioelectricity within a body may cause a change in capacitance of such elements in a vicinity of a location touched by the body (e.g., a digit such as a finger or thumb), due to disruptions in electrical fields caused by the body's presence, thereby further causing a change in the time constant of the RFID tag, and a discharge of the capacitor in an amount that may be defined as a function of the resistance of the capacitive elements.

According to some embodiments, such capacitive elements may be formed into a layered stack or may include a substantially linear or planar gap or break, and may be covered with a flexible protective layer formed from one or more plastics or rubbers (e.g., acrylics, vinyls, polyurethanes or the like), or other like materials. The protective layer may be adhered to one or more capacitive elements of an RFID circuit, which may include elements formed from a conductive material such as aluminum, copper, silicon or indium tin oxide that are separated by an air gap. When a user touches a protective layer of an RFID tag with a finger, which is a bioelectric conductor, a change in the effective capacitance (on the order of approximately one picofarad) between the elements, which are also conductors, in a vicinity of a point or points of contact with the protective layer is introduced. Such contact forms a conductive bridge across the elements, thereby causing disruptions in electrical fields in the vicinity of one or more of the elements, and further causing an internal current flow through the RFID tag circuit.

In addition to capacitive elements, a circuit of an RFID tag may include other components for enabling a manual actuation thereof by a human or a machine, including one or more substantially planar conductive elements that may be separated by an air gap. Such an air gap between the conductive elements defines an open switch within the circuit of the RFID tag, which may also be covered with a flexible protective layer that may be formed from one or more plastics, rubbers or other like materials. When a user contacts an external surface of the RFID tag corresponding to the air gap, e.g., the flexible protective layer over the air gap, at least two of the conductive elements are placed in contact with one another, thereby bridging the air gap between the conductive elements and closing the open switch. Subsequently, an internal current flow through the RFID tag circuit is enabled. Because the bridging of the air gap and the closure of the open switch is registered by manually driven electrical contact, a manually activated RFID tag including substantially planar conductive elements does not require bioelectricity in order to operate properly, and a user may interact with the RFID tag using not only his or her fingers or hands (which may be gloved or ungloved) but also a stylus, a pointer or another like object.

The systems and methods of the present disclosure are directed to monitoring compliance with safety requirements, standards or regulations based on RFID signals that are received from one or more RFID tags, particularly manually activated RFID tags that are placed in one or more convenient and accessible locations within a designated environment where such requirements, standards or regulations remain in effect. In particular, the systems and methods disclosed herein are directed to determining a type or identity of a human (e.g., a worker) participating in an activity, or a number of participating humans, and determining whether or how many of the humans are adhering to such standards based at least in part on signals received from the manually activated RFID tags. The type, the identity or the number of humans may be determined on any basis, including but not limited to RFID signals received from standard passive RFID tags associated with such humans, or other readily available systems or methods for determining the type, the identity or the number of such humans, including but not limited to mass-measuring scales, imaging devices or other optical sensors, or computer-based methods for interpreting information received from such scales, imaging devices or optical sensors.

Once a determination is made as to the extent to which humans participating in an activity are complying with one or more requirements, standards or regulations, information regarding a level of compliance may be stored in at least one data store, and a type of feedback relating to the level of compliance may be identified and provided to such humans by any means. For example, where a level of compliance is objectively determined with regard to a number of workers, and not specifically isolated to a particular worker, feedback may be provided in the form of one or more ambient, unobtrusive signals or messages. Such signals may include soft lights, basic sounds or general messages (e.g., electronic mail, or E-mail) provided to such workers, or a larger group of workers, thereby reminding the workers of any relevant requirements, standards or regulations. Alternatively, where a level of compliance may be isolated to a given worker or workers who may have an established history of failing to comply with the requirements, standards or regulations, feedback in the form of targeted lights or sounds, or specific messages, may be provided to the workers. Feedback may be provided in advance of an activity or exercise, or during the performance of the activity or exercise, to one or more of the workers.

Moreover, where the requirements, standards or regulations that have not been complied with are neither critical to safety nor associated with a significant economic risk, feedback in the form of tempered signals or messages may be provided to one or more workers. Conversely, where such requirements, standards or regulations are essential to safety, or may result in the risk of substantial economic damage, physical harm or death, direct and pointed feedback may be immediately provided to a particular worker or workers, and in a clear and prominent manner (e.g., with loud sirens or bright warning lights). Furthermore, information or data regarding participation or compliance with in-place requirements, standards or regulations may be maintained in at least one data store and utilized for any purpose, including a real time or near-real time review of participation or compliance, as well as a forensic review of historic performance with regard to such requirements, standards or regulations. For example, such information may be used at a later time to identify, evaluate or audit one or more of a level of compliance by an individual or a group of individuals with regard to one or more requirements, standards or regulations during an activity, and may identify one or more of the individuals associated with the activity, as well as any other information (e.g., dates or times) regarding the activity or the compliance with such requirements, standards or regulations.

Those of ordinary skill in the pertinent arts will recognize that the systems and methods of the present disclosure may be utilized in any environment in which a requirement, a standard or a regulation requires a human to manually grasp or hold one or more grippable or structural elements. Such elements may include but are not limited to handrails on staircases, such as the set of stairs 135 and the handrail 160 provided at the industrial facility 130 of FIG. 1, as well as escalators, moving walkways, amusement rides, steering wheels, grab bars, free weights, exercise machines, bicycles, firearms or any other machines or apparatuses having one or more associated requirements, standards or regulations that may be predicated upon or otherwise mandate proper manual contact or control.

Figure 2:
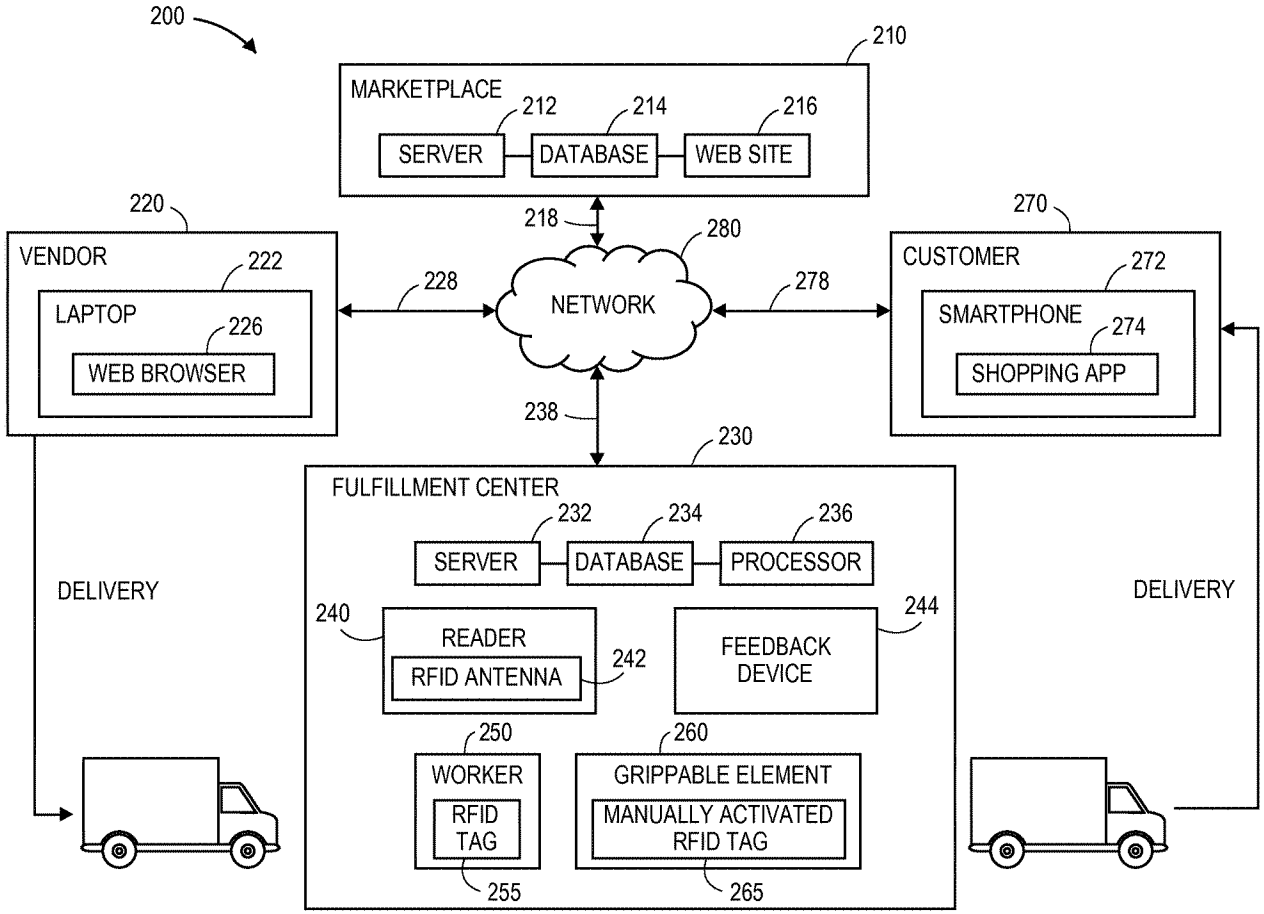
FIG. 2 is a block diagram of components of one system for monitoring safety compliance based on RFID signals, in accordance with embodiments of the present disclosure.

Referring to FIG. 2, a block diagram of components of one system 200 for monitoring safety compliance based on RFID signals is shown. The system 200 includes a marketplace 210, a vendor 220, a fulfillment center 230 and a customer 270 that are connected to one another across a network 280, such as the Internet. Except where otherwise noted, reference numerals preceded by the number "2" in FIG. 2 indicate components or features that are similar to components or features having reference numerals preceded by the number "1" shown in FIG. 1.

The marketplace 210 may be any entity or individual that wishes to make items from a variety of sources available for download, purchase, rent, lease or borrowing by customers using a networked computer infrastructure, including one or more physical computer servers 212 and databases (or other data stores) 214 for hosting a web site 216. The marketplace 210 may be physically or virtually associated with one or more storage or distribution facilities, such as the fulfillment center 230. The web site 216 may be implemented using the one or more servers 212, which connect or otherwise communicate with the one or more databases 214 as well as the network 280, as indicated by line 218, through the sending and receiving of digital data. Moreover, the database 214 may include any type of information regarding items that have been made available for sale through the marketplace 210, or ordered by customers from the marketplace 210.

The vendor 220 may be any entity or individual that wishes to make one or more items available to customers, such as the customer 270, by way of the marketplace 210. The vendor 220 may operate one or more order processing and/or communication systems using a computing device such as a laptop computer 222 and/or software applications such as a web browser 226, which may be implemented through one or more computing machines that may be connected to the network 280, as is indicated by line 228, in order to transmit or receive information regarding one or more items to be made available at the marketplace 210, in the form of digital or analog data, or for any other purpose.

The vendor 220 may deliver one or more items to one or more designated facilities maintained by or on behalf of the marketplace 210, such as the fulfillment center 230. Additionally, the vendor 220 may receive one or more items from other vendors, manufacturers or sellers (not shown), and may deliver one or more of such items to locations designated by the marketplace 210, such as the fulfillment center 230, for fulfillment and distribution to customers. Furthermore, the vendor 220 may perform multiple functions. For example, the vendor 220 may also be a manufacturer and/or a seller of one or more other items, and may offer items for purchase by customers at venues (not shown) other than the marketplace 210. Additionally, items that are made available at the marketplace 210 or ordered therefrom by customers may be made by or obtained from one or more third party sources, other than the vendor 220, or from any other source (not shown). Moreover, the marketplace 210 itself may be a vendor, a seller or a manufacturer.

The fulfillment center 230 may be any facility that is adapted to receive, store, process and/or distribute items. As is shown in FIG. 2, the fulfillment center 230 includes a networked computer infrastructure for performing various computer-related functions associated with the receipt, storage, processing and distribution of such items, including one or more physical computer servers 232, databases (or other data stores) 234 and processors 236. The fulfillment center 230 may also include stations for receiving, storing and distributing items to customers, such as one or more receiving stations, storage areas and distribution stations. The fulfillment center 230 further includes at least one RFID reader 240 having an antenna 242, and a feedback device 244.

The RFID reader 240 is any type of sensor or interrogator that may be provided for use in connection with signals transmitted from one or more active or passive RFID tags. The RFID reader 240 may include one or more components for transmitting or receiving signals, such as the antenna 242, as well as various circuitry components for processing and controlling the operation of the RFID reader 240. Additionally, the RFID reader 240 may communicate with RFID tags by way of any coupling modes or methods that may be known to those of ordinary skill in the pertinent arts. For example, an RFID tag may modulate one or more elements of the data stored thereon, and transmit a modulated data signal to a receiving circuit associated with the RFID reader 240. Subsequently, the RFID reader 240 may then demodulate the data signal, and provide a processed set of data derived from the data signal to the server 232 or another computer for further processing.

Moreover, the RFID reader 240 may be configured to capture, evaluate, transmit or store any available information regarding signals received from one or more RFID tags, including information regarding any attributes of the signals, including sensed signal strengths or intensities, as well as angular directions or ranges to the RFID tags from which such signals were received, or any differences between the strengths, intensities, angular orientations or ranges associated with two or more signals. Although the fulfillment center 230 of FIG. 2 includes a single RFID reader 240, those of ordinary skill in the pertinent arts will recognize that any number of RFID readers 240 may be provided throughout a fulfillment center environment, and in any number of specified stations or locations, in accordance with the present disclosure.

The feedback device 244 may be any output device, system or component for providing feedback of any type or form to one or more humans. The feedback device 244 may include one or more computer components, such as a speaker for playing audio content, a monitor or computer display for displaying video content, or a combined speaker and monitor for rendering multimedia content, as well as other components such as lights of any color or intensity, or bells, chimes or any other component for generating sounds. The feedback device 244 may be operated or controlled by one or more computer components within the fulfillment center 230, such as the server 232, or one or more external computer components, such as the marketplace server 212, or any other device that may connect to the feedback device 244 over the network 280.

As is also shown in FIG. 2, the fulfillment center 230 also includes at least one worker 250, who may be any designated personnel tasked with performing one or more tasks within the fulfillment center 230, and may wear, carry or otherwise be associated with or adorned with an RFID tag 255. The worker 250 may handle or transport items within the fulfillment center 230, operate one or more pieces of equipment therein (not shown). The worker 250 may also operate one or more specific computing devices or machines for registering the receipt, retrieval, transportation or storage of items within the fulfillment center 230, or a general purpose device such a personal digital assistant, a digital media player, a smartphone, a tablet computer, a desktop computer or a laptop computer (not shown), which may include any form of input and/or output peripherals such as scanners, readers, keyboards, keypads, touchscreens or like devices. The RFID tag 255 may be any form of RFID transmitting and/or receiving component that may be associated with the worker 250, and may be coupled with the RFID reader 240 by any means.

The grippable element 260 may be any physical or structural component of the fulfillment center 230 that is designed or intended to be manually handled, e.g., grasped or held, by personnel within the fulfillment center 230. For example, the grippable element 260 may be a handrail associated with a set of stairs, a rung of a ladder, a handle of a tool, a doorknob, a controller on a piece of motorized equipment, a shaft of a writing implement or anything else that may be operated or grasped in a hand. As is discussed above, the manually activated RFID tag 265 may be an RFID tag of any type or form that may be mounted to the grippable element 260 and coupled with an RFID reader, such as the RFID reader 240, upon manual contact. For example, the manually activated RFID tag 265 may be applied to the grippable element 260 in the form of a label, wrapped around the grippable element 260 or embedded within or formed from one or more layers or components of the grippable element 260. The manually activated RFID tag 265 may be programmed with any relevant information or data relating to the grippable element 260 or the fulfillment center 230, and may be configured to transmit such information or data upon a coupling with an RFID reader.

The fulfillment center 230 may further operate one or more order processing and/or communication systems using computer devices in communication with one or more of the server 232, the database 234 and/or the processor 236, or through one or more other computing devices or machines that may be connected to the network 280, as is indicated by line 238, in order to transmit or receive information in the form of digital or analog data, or for any other purpose. Such computer devices may also operate or provide access to one or more reporting systems for receiving or displaying information or data regarding workflow operations, and may provide one or more interfaces for receiving interactions (e.g., text, numeric entries or selections) from one or more operators, users or workers in response to such information or data. Such computer devices may be general purpose devices or machines, or dedicated devices or machines that feature any form of input and/or output peripherals such as scanners, readers, keyboards, keypads, touchscreens or like devices, and may further operate or provide access to one or more engines for analyzing the information or data regarding the workflow operations, or the interactions received from the one or more operators, users or workers.

Additionally, as is discussed above, the fulfillment center 230 may include one or more receiving stations featuring any apparatuses that may be required in order to receive shipments of items at the fulfillment center 230 from one or more sources and/or through one or more channels, including but not limited to docks, lifts, cranes, jacks, belts or other conveying apparatuses for obtaining items and/or shipments of items from carriers such as cars, trucks, trailers, freight cars, container ships or cargo aircraft (e.g., manned aircraft or unmanned aircraft, such as drones), and preparing such items for storage or distribution to customers. The fulfillment center 230 may also include one or more predefined two-dimensional or three-dimensional storage areas including facilities for accommodating items and/or containers of such items, such as aisles, rows, bays, shelves, slots, bins, racks, tiers, bars, hooks, cubbies or other like storage means, or any other appropriate regions or stations. The fulfillment center 230 may further include one or more distribution stations where items that have been retrieved from a designated storage area may be evaluated, prepared and packed for delivery from the fulfillment center 230 to addresses, locations or destinations specified by customers, also by way of carriers such as cars, trucks, trailers, freight cars, container ships or cargo aircraft (e.g., manned aircraft or unmanned aircraft, such as drones).

Moreover, the fulfillment center 230 may further include one or more control systems that may generate instructions for conducting operations at the fulfillment center 230, and may be in communication with the RFID reader 240, the worker 250 or the grippable element 260 at the fulfillment center 230. Such control systems may also be associated with one or more other computing devices or machines, and may communicate with the marketplace 210, the vendor 220 or the customer 270 over the network 280, as indicated by line 238, through the sending and receiving of digital data.

The customer 270 may be any entity or individual that wishes to download, purchase, rent, lease, borrow or otherwise obtain items (e.g., goods, products, services or information of any type or form) from the marketplace 210. The customer 270 may utilize one or more computing devices, such as a smartphone 272 or any other like machine that may operate or access one or more software applications, such as a web browser (not shown) or a shopping application 274, and may be connected to or otherwise communicate with the marketplace 210, the vendor 220 or the fulfillment center 230 through the network 280, as indicated by line 278, by the transmission and receipt of digital data. Moreover, the customer 270 may also receive deliveries or shipments of one or items from facilities maintained by or on behalf of the marketplace 210, such as the fulfillment center 230, or from the vendor 220.

The computers, servers, devices and the like described herein have the necessary electronics, software, memory, storage, databases, firmware, logic/state machines, microprocessors, communication links, displays or other visual or audio user interfaces, printing devices, and any other input/output interfaces to provide any of the functions or services described herein and/or achieve the results described herein. Also, those of ordinary skill in the pertinent art will recognize that users of such computers, servers, devices and the like may operate a keyboard, keypad, mouse, stylus, touch screen, or other device (not shown) or method to interact with the computers, servers, devices and the like, or to "select" an item, link, node, hub or any other aspect of the present disclosure.

Those of ordinary skill in the pertinent arts will understand that process steps described herein as being performed by a "marketplace," a "vendor," a "fulfillment center," a "worker," or a "customer," or like terms, may be automated steps performed by their respective computer systems, or implemented within software modules (or computer programs) executed by one or more general purpose computers. Moreover, process steps described as being performed by a "marketplace," a "vendor," a "fulfillment center," a "worker," or a "customer" may be typically performed by a human operator, but could, alternatively, be performed by an automated agent.

The marketplace 210, the vendor 220, the fulfillment center 230, the RFID reader 240, the worker 250, and/or the customer 270 may use any web-enabled or Internet applications or features, or any other client-server applications or features including E-mail or other messaging techniques, to connect to the network 280 or to communicate with one another, such as through short or multimedia messaging service (SMS or MMS) text messages. For example, the server 232 may be adapted to transmit information or data in the form of synchronous or asynchronous messages from the fulfillment center 230 to the server 212, the laptop computer 222, the smartphone 272 or any other computer device in real time or in near-real time, or in one or more offline processes, via the network 280. Those of ordinary skill in the pertinent art would recognize that the marketplace 210, the vendor 220, the fulfillment center 230, the RFID reader 240, the worker 250 or the customer 270 may operate any of a number of computing devices that are capable of communicating over the network, including but not limited to set-top boxes, personal digital assistants, digital media players, web pads, laptop computers, desktop computers, electronic book readers, and the like. The protocols and components for providing communication between such devices are well known to those skilled in the art of computer communications and need not be described in more detail herein.

The data and/or computer executable instructions, programs, firmware, software and the like (also referred to herein as "computer executable" components) described herein may be stored on a computer-readable medium that is within or accessible by computers or computer components such as the server 212, the laptop computer 222, the server 232, or the smartphone 272, or any other computers or control systems utilized by the marketplace 210, the vendor 220, the fulfillment center 230, the RFID reader 240, the worker 250 or the customer 270 and having sequences of instructions which, when executed by a processor (e.g., a central processing unit, or "CPU"), cause the processor to perform all or a portion of the functions, services and/or methods described herein. Such computer executable instructions, programs, software and the like may be loaded into the memory of one or more computers using a drive mechanism associated with the computer readable medium, such as a floppy drive, CD-ROM drive, DVD-ROM drive, network interface, or the like, or via external connections.

Some embodiments of the systems and methods of the present disclosure may also be provided as a computer executable program product including a non-transitory machine-readable storage medium having stored thereon instructions (in compressed or uncompressed form) that may be used to program a computer (or other electronic device) to perform processes or methods described herein. The machine-readable storage medium may include, but is not limited to, hard drives, floppy diskettes, optical disks, CD-ROMs, DVDs, ROMs, RAMs, erasable programmable ROMs ("EPROM"), electrically erasable programmable ROMs ("EEPROM"), flash memory, magnetic or optical cards, solid-state memory devices, or other types of media/machine-readable medium that may be suitable for storing electronic instructions. Further, embodiments may also be provided as a computer executable program product that includes a transitory machine-readable signal (in compressed or uncompressed form). Examples of machine-readable signals, whether modulated using a carrier or not, may include, but are not limited to, signals that a computer system or machine hosting or running a computer program can be configured to access, or including signals that may be downloaded through the Internet or other networks.

Although some of the embodiments disclosed herein reference the use of RFID readers and manually activated RFID tags for monitoring the adherence with safety requirements, standards or regulations in a fulfillment center environment, the systems and methods are not so limited. Rather, the systems and methods disclosed herein may be utilized in any environment in which a confirmation as to the extent or frequency with which contact is made with one or more grippable elements is desired, wherein one or more manually activated RFID tags are applied to the grippable elements for this purpose. Such systems and methods are particularly useful in environments where such a confirmation must be made relatively quickly, and with a high degree of accuracy, including but not limited to environments in which traditional power supplies are not reliable or may not be readily accessed.

Moreover, although some of the embodiments reference the use of RFID readers to monitor the adherence with safety requirements, standards or regulations based on advertent contact with a grippable element or a structural element to which one or more manually activated RFID tags is applied, the systems and methods are not so limited. Rather, one or more manually activated RFID tags may be provided in a location where manual contact is not desired, thereby transmitting an RFID signal once the manual contact with one or more of such tags is detected. For example, manually activated RFID tags including two or more capacitive elements that define a capacitor within the RFID tag may be disposed on one or more stairs of a staircase, or on one or more moving stairs of an escalator. Because a pair of rubber- or leather-soled shoes typically cannot transfer bioelectricity, the manually activated RFID tags will not be activated by persons who comply with requirements to wear shoes or to hold a handrail while traveling on the staircase or the escalator. However, if a worker travels on the staircase or the escalator without shoes, or slips and falls, the manually activated RFID tags contacted by the worker's skin may cause one or more RFID signals to be transmitted to an external server, which may further provide feedback to the worker traveling on the staircase or stop the moving escalator, as necessary.

Furthermore, such manually activated RFID tags may be provided in different locations in concert with one another. For example, where a plurality of manually activated RFID tags are provided on a handrail associated with a set of stairs, and also on the stairs themselves, compliance with a requirement to hold the handrail may be determined based on the number of contacts with the manually activated RFID tags. Alternatively, if a worker slips and falls while traveling up or down the set of stairs, the worker's condition may be identified based not only on a loss of contact with at least one of the manually activated RFID tags on the handrail but also on a gain of a contact with at least one of the manually activated RFID tags on one or more of the stairs.

Furthermore, receiving an RFID signal based on contact with a manually activated RFID tag may be associated with positive feedback or with negative feedback, depending on the circumstances under which the contact was made or the RFID signal was received. For example, where an airlock, a vault or another location is intended to remain open or unsecured, receiving an RFID signal based on contact with a manually activated RFID tag disposed on a handwheel or operator of an entry (e.g., a door) to the airlock, the vault or the other location may be deemed harmless or irrelevant. Where the airlock, the vault or the other location is intended to remain closed or secured, however, receiving an RFID signal based on contact with the manually activated RFID tag disposed on the handwheel or the operator of the entry may cause one or more lights to be illuminated, sounds to be displayed, or other feedback signals to be generated and provided to one or more computer devices.

As is discussed above, the systems and methods of the present disclosure are directed to monitoring safety compliance based on contact with one or more manually activated RFID tags, including but not limited to tags that are provided on one or more grippable elements having one or more relevant requirements, standards or regulations. For example, a number of such signals that are received may be compared to a number of signals that were expected in a nearly or fully compliant scenario, i.e., where most or each of a plurality of humans is in compliance with a relevant requirement, standard or regulation. Information regarding the number of signals that were received, and the number of signals that were expected, may be captured and stored in at least one data store, and subject to further processing.

Figure 3:
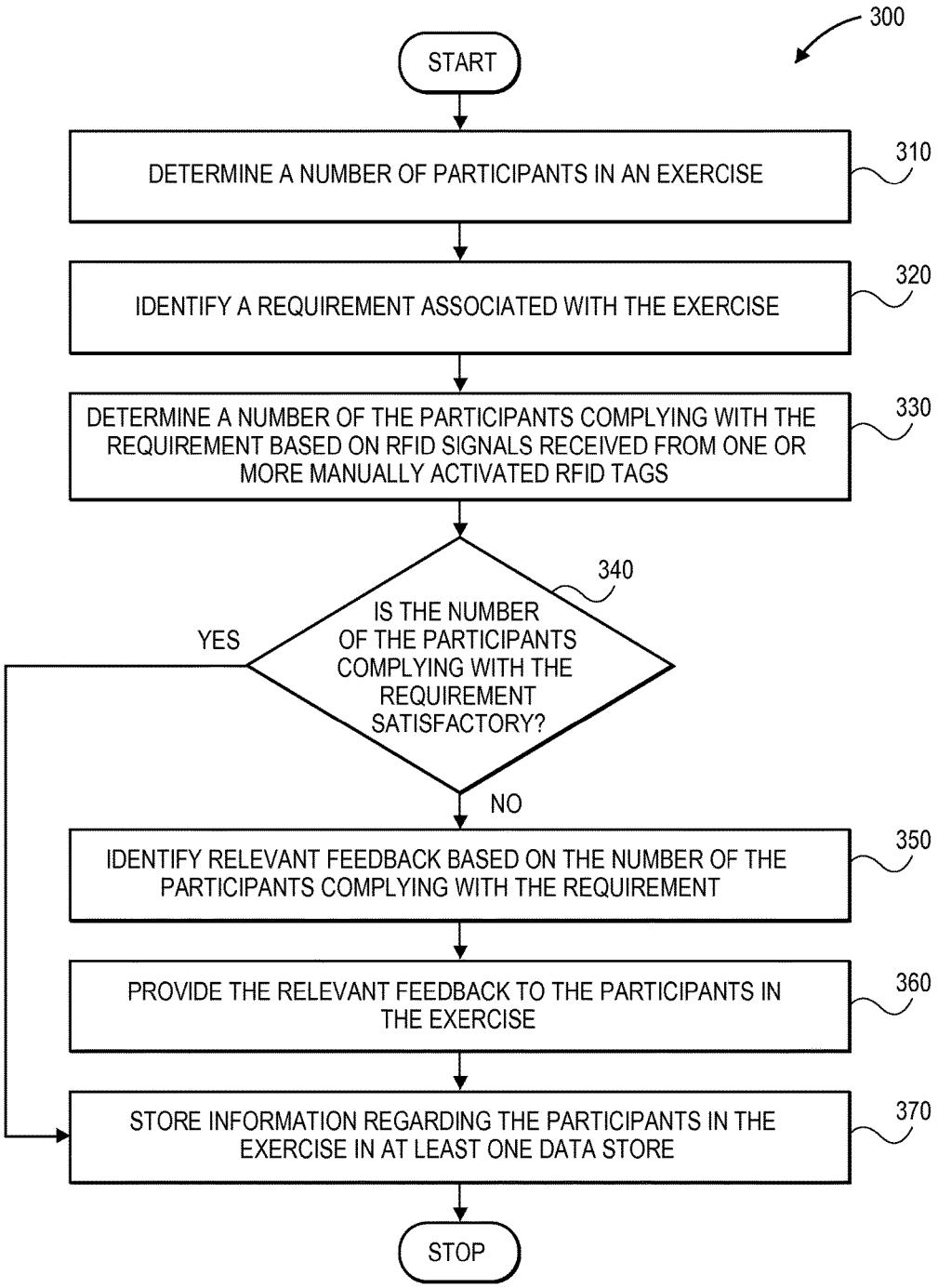
FIG. 3 is a flow chart of one process for monitoring safety compliance based on RFID signals, in accordance with embodiments of the present disclosure.

Referring to FIG. 3, a flow chart 300 representing one embodiment of a process for monitoring safety compliance based on RFID signals is shown. At box 310, a number of participants in an exercise is determined. Such a number may be determined manually or automatically by one or more means. For example, where an activity relates to workers climbing or descending a set of stairs, each of the workers on the set of stairs may wear a badge that has been assigned to the worker, and includes a passive RFID tag which transmits an identifier of the worker (e.g., a name or number associated with the worker) to an RFID reader within a sufficient range. Alternatively, a number of the workers may be determined from one or more scales or other mass-measuring apparatuses associated with the set of stairs, which may determine a total live load on the stairs, and from which a number of workers on the set of stairs may be estimated. Any means for determining a number of participants in the exercise may be utilized in accordance with the present disclosure.

At box 320, a requirement associated with the exercise is identified, and at box 330, a number of the participants complying with the requirement is determined based on RFID signals received from one or more manually activated RFID tags. For example, where an activity involves climbing or descending a set of stairs, workers may be required to hold a handrail while traveling up or down the set of stairs. Alternatively, where the activity involves operating an automobile or other piece of machinery, a worker may be required to use a certain number of his or her hands when operating the machinery, or to place his or her hands in a predetermined location while operating the machinery.

At box 340, whether the number of participants complying with the requirement identified at box 320 is satisfactory is determined. For example, where workers climbing or descending a set of stairs are required to hold a handrail, a predetermined threshold of workers who must hold the handrail, e.g., ninety-five percent (95%), in order for compliance to be deemed sufficient may be determined. Alternatively, where strict compliance with a requirement is desired, a failure of just one worker to comply with the requirement may be deemed insufficient. The sufficiency of a level of compliance may be determined on any basis in accordance with embodiments of the present disclosure.

If the number of the participants who are complying with the requirement is unsatisfactory, then the process advances to box 350, where relevant feedback is identified based on the number of the participants complying with the requirement identified at box 320. For example, if a number of workers who have failed to comply with the requirement is small in real or relative terms, ambient feedback (e.g., lights, sounds or mildly toned messages) may be identified and provided to all workers in general, or to the workers who failed to comply in particular, for the purpose of reminding such workers of their obligation to follow all relevant requirements, standards or regulations, including but not limited to the requirement. Alternatively, where the number of workers who have failed to comply with the requirement is large in real or relative terms, direct or plainly evident feedback (e.g., loud alarms or bright lights) may be identified for all workers in general, or for the non-compliant workers in particular. The relevant feedback identified at box 350 may be positive or negative in nature, and as general or as specific as is necessary, in accordance with the present disclosure.

At box 360, the relevant feedback identified at box 350 is provided to the participants in the exercise. For example, where the relevant feedback identified at box 350 includes one or more ambient lights or sounds, such lights may be displayed to the participants, or such sounds may be played within earshot of the participants. Where the relevant feedback identified at box 350 includes a predetermined audio or video message, the audio or video message may be played on one or more speakers or displayed on one or more computer displays. Where the relevant feedback is an E-mail message, the E-mail message may be transmitted to one or more workers who failed to comply with the requirement, or to a group of workers as a whole.

If the number of the participants who are complying with the requirement is satisfactory, or after providing the relevant feedback to the participants in the exercise, the process advances to box 370, where information regarding the participants in the exercise is stored in at least one data store. The information may include general statistics or data regarding the participants and their levels of compliance with the requirement during the exercise, or particularized information regarding respective participants and their individual levels of compliance with the requirement, as well as relevant information such as a time or date when the exercise was performed, or a location at which the exercise was performed.

Accordingly, the systems and methods of the present disclosure may capture information or data regarding compliance with one or more requirements, standards or regulations, e.g., safety rules, by one or more participants in an exercise, and may determine an overall general level of compliance with such requirements, standards or regulations by such participants, or specific levels of compliance by individual participants, based on RFID signals received from one or more manually activated RFID tags provided in designated locations associated with the exercise. Once a determination is made as to the general or specific levels of compliance by such workers, relevant feedback of any type or form may be identified for one or more of the workers, and provided to such workers by any means.

Figure 4:
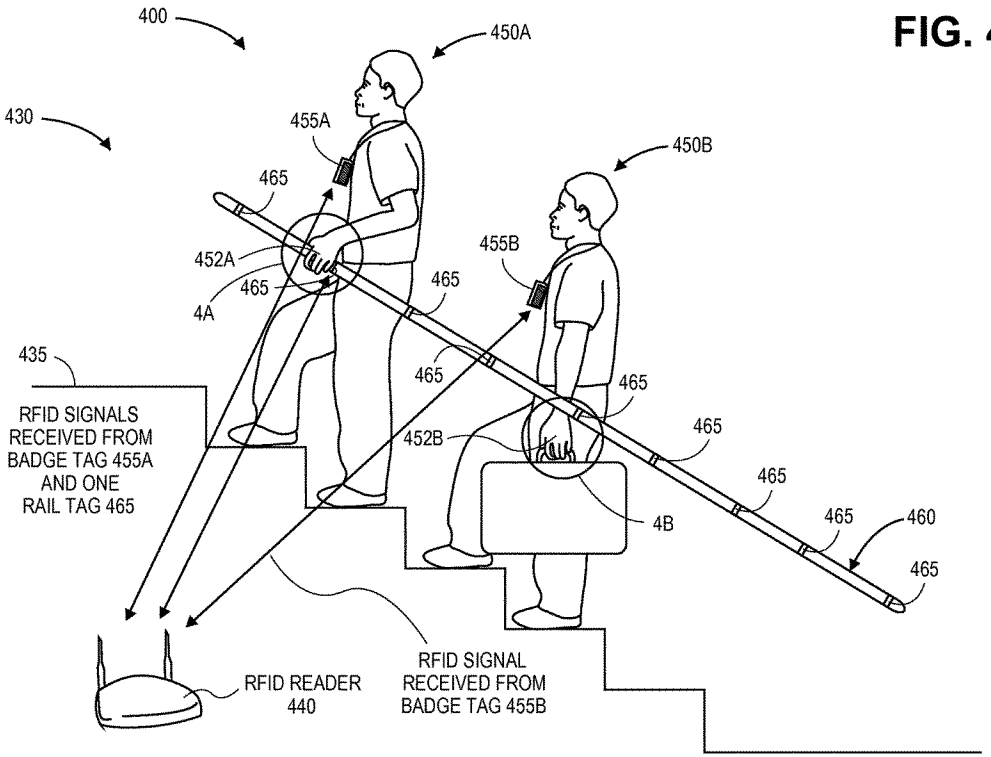
FIG. 4 is a view of one system for monitoring safety compliance based on RFID signals, in accordance with embodiments of the present disclosure.

One example of a system for monitoring safety compliance based on RFID signals in accordance with the present disclosure is shown in FIG. 4. Referring to FIG. 4, a system 400 includes a working environment 430 having a set of stairs 435 therein, an RFID reader 440 and a handrail 460 with a plurality of manually activated RFID tags 465 disposed thereon. Except where otherwise noted, reference numerals preceded by the number "4" in FIG. 4 indicate components or features that are similar to components or features having reference numerals preceded by the number "2" shown in FIG. 2, or by the number "1" shown in FIG. 1.

As is shown in FIG. 4, two workers 450A, 450B are ascending the set of stairs 435. Each of the workers 450A, 450B is wearing an identification badge 455A, 455B including a passive RFID tag that has been assigned to the worker 450A, 450B. Additionally, a hand 452A of the worker 450A is gripping the handrail 460, and contacting one or more of the manually activated RFID tags 465, as is shown at 4A, while a hand 452B of the worker 450B is neither gripping the handrail 460 nor contacting any of the manually activated RFID tags 465 on the handrail 460, as is shown at 4B.

According to the present disclosure, a level of compliance with one or more requirements, viz., a requirement to hold the handrail 460 while traveling up or down the set of stairs 430, may be determined by the system 400. Specifically, the workers 450A, 450B may be identified based on their respectively assigned identification badges 455A, 455B, and a number of instances of contact between the workers 450A, 450B and the handrail 460 may be determined based at least in part on the number of RFID signals received from the manually activated RFID tag 465. As is shown in FIG. 4, RFID signals are received from the identification badge 455A worn by the worker 450A, and a manually activated RFID tag 465 gripped by the worker 450A, as well as from the identification badge 455B worn by the worker 450B. Therefore, according to the present disclosure, the system 400 is able to generally determine that two workers 450A, 450B are climbing the set of stairs 435 but that only one of the workers is gripping the handrail 460, by counting the number of RFID signals received from identification badges 455A, 455B, and the number of RFID signals received from manually activated RFID tags 465, and comparing the numbers of RFID signals that are received to one another.

Alternatively, the system 400 may further specifically determine that the worker 450A is gripping the handrail 460 based on the proximity of the RFID signals received from the identification badge 455A and the manually activated RFID tag 465 gripped by the hand 452A to one another, and also that the worker 450B is not gripping the handrail 460, based on the absence of any RFID signal received from any corresponding manually activated RFID tag 465 in a vicinity of the worker 450B. Moreover, where it is determined through prior experience and/or historical observations that one or more of the workers 450A, 450B is particularly reliable or unreliable with regard to one or more requirements, relevant feedback may be identified for such workers 450A, 450B once the workers 450A, 450B have been identified based on signals received from the identification badges 455A, 455B by the RFID reader 440.

Figure 5:
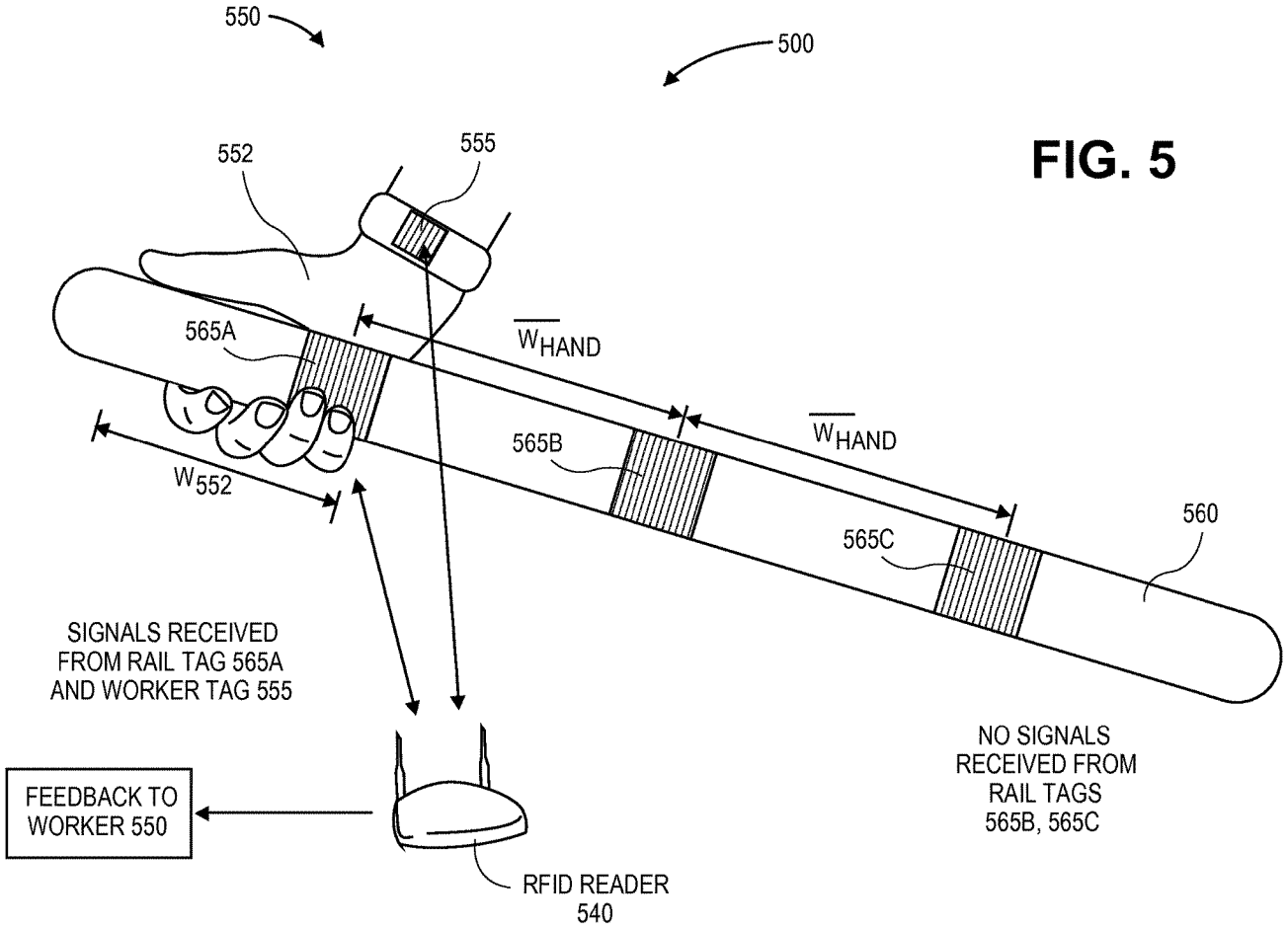
FIG. 5 is a view of components of one system for monitoring safety compliance based on RFID signals, in accordance with embodiments of the present disclosure.

In accordance with the present disclosure, RFID signals may be received from manually activated RFID tags that are provided in any manner and at any location with regard to a grippable element, such as the handrail 460 of FIG. 4. Referring to FIG. 5, a system 500 includes an RFID reader 540, a handrail 560 with a plurality of manually activated RFID tags 565A, 565B, 565C disposed thereon and a hand 552 of a worker 550 gripping the handrail 560. Except where otherwise noted, reference numerals preceded by the number "5" in FIG. 5 indicate components or features that are similar to components or features having reference numerals preceded by the number "4" shown in FIG. 4, by the number "2" shown in FIG. 2, or by the number "1" shown in FIG. 1.

As is shown in FIG. 5, the hand 552 of the worker 550 is gripping the handrail 560 and contacting one of the manually activated RFID tags 565A. Additionally, the worker 560 is further wearing a wearable RFID tag 555 (viz., a bracelet) near the hand 552. In accordance with the present disclosure, the RFID reader 540 may receive signals from not only the wearable RFID tag 555 but also the manually activated RFID tag 565A, thereby indicating that a number of persons in a vicinity of the RFID reader 540 (viz., one) matches a number of sensed contacts with the handrail 560 (viz., one). Accordingly, positive feedback regarding the compliance of the worker 550 with a requirement to hold the handrail 560 may be provided to the worker 550 in the form of ambient lights, sounds or messages. If the worker 550 had not contacted the handrail 560, however, no RFID signals would have been received from any of the manually activated RFID tags 565A, 565B, 565C, and the number of persons in the vicinity of the RFID reader 540 (viz., one) would exceed the number of sensed contacts with the handrail 560 (viz., zero). In such a scenario, negative or constructive feedback reminding the worker 550 of the requirement to hold the handrail 560 could be provided to the worker 550 in the form of lights, sounds or messages.

Additionally, as is also shown in FIG. 5, the various manually activated RFID tags 565A, 565B, 565C could be provided on the handrail 560 in a defined spatial relationship, e.g., at selected distances from one another, in order to ensure or at least increase a likelihood that a person gripping the handrail 560 will also contact at least one of the manually activated RFID tags 565A, 565B, 565C. For example, as is shown in FIG. 5, the manually activated RFID tags 565A, 565B, 565C may be provided at distances corresponding to an average width of a hand $w_{HAND}$. Therefore, when the hand 552 of the worker 550 contacts the handrail 560, a width $w_{552}$ of the hand 552 is likely to contact at least one of the manually activated RFID tags 565A, 565B, 565C, thereby causing at least one RFID signal to be transmitted from a manually activated RFID tag 565A, 565B, 565C to the RFID reader 540, indicating that at least one contact is made with the handrail 560.

Figure 6:
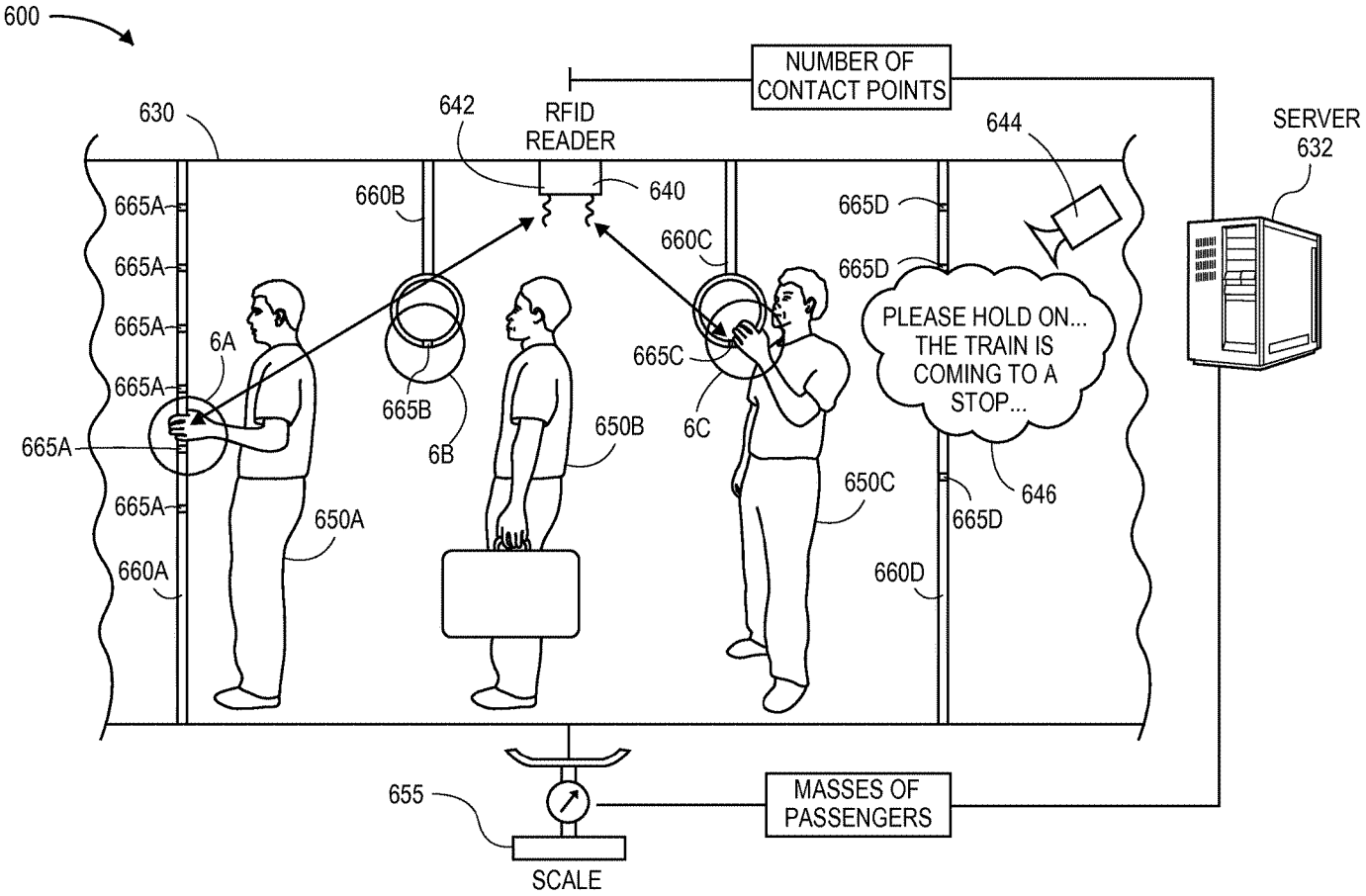
FIG. 6 is a view of one system for monitoring safety compliance based on RFID signals, in accordance with embodiments of the present disclosure.

As is discussed above, the systems and methods of the present disclosure are not limited to applications involving staircases or sets of stairs, or to grippable elements in the form of handrails, and may be used in any number of other applications in which a confirmation as to compliance with one or more relevant safety requirements, standards or regulations involving contact or control is desired. Referring to FIG. 6, a system 600 for monitoring safety compliance based on RFID signals includes a train car 630, a server 632, an RFID reader 640, a speaker 644, a scale 655, support bars 660A, 660D and support rings 660B, 660C, with a plurality of manually activated RFID tags 665A, 665B, 665C, 665D disposed thereon. Except where otherwise noted, reference numerals preceded by the number "6" in FIG. 6 indicate components or features that are similar to components or features having reference numerals preceded by the number "5" shown in FIG. 5, by the number "4" shown in FIG. 4, by the number "2" shown in FIG. 2, or by the number "1" shown in FIG. 1.

As is shown in FIG. 6, three passengers 650A, 650B, 650C are present in train car 630. The passenger 650A is gripping the support bar 660A, and making contact with one or more of the manually activated RFID tags 665A disposed thereon. As is also shown in FIG. 6, the passenger 650B is not gripping the support ring 660B, and no contact is therefore made with the RFID tag 665B disposed thereon. Additionally, the passenger 650C is gripping the support ring 660C, and thereby making contact with the RFID tag 665C disposed thereon, while no passenger is gripping the support bar 660D. The scale 655 is provided to determine a mass of the passengers within the train car 630, e.g., a live load associated with the passengers 650A, 650B, 650C, which may be used to calculate or estimate a number of passengers traveling therein.

The systems and methods of the present disclosure may be used to determine a level of compliance with a safety standard, such as a recommendation that passengers hold a safety bar, a safety ring or another safety apparatus within a moving vehicle, e.g., the train car 630. As is discussed above, a number of the passengers 650A, 650B, 650C traveling within the train car 630 may be determined or estimated and compared to a number of RFID signals received from contact with the manually activated RFID tags 665A, 665B, 665C, 665D provided therein. Specifically, as is shown in FIG. 6, information regarding a number of contact points may be provided from the RFID reader 640 to a server 632, and information regarding a mass of passengers may be provided from the scale 655 to the server 632, which may be interpreted in order to determine or estimate the number of passengers 650A, 650B, 650C within the train car 630.

Based on such information, the server 632 identifies relevant feedback to be provided to the passengers 650A, 650B, 650C. As is shown in FIG. 6, the speaker 644 provides feedback 646 in the form of an audio message indicating that the train car 630 is about to stop, and that holding the support bars 660A, 660D or the support rings 660B, 660C is recommended. Alternatively, where one or more of the passengers 650A, 650B, 650C have been identified by various means described herein and have an established history or probability of a lack of compliance with the safety standard, feedback 646 in the form of an audio message that has been particularly tailored to or selected for one or more of the passengers 650A, 650B, 650C may be played from the speaker 644.

Figure 7:
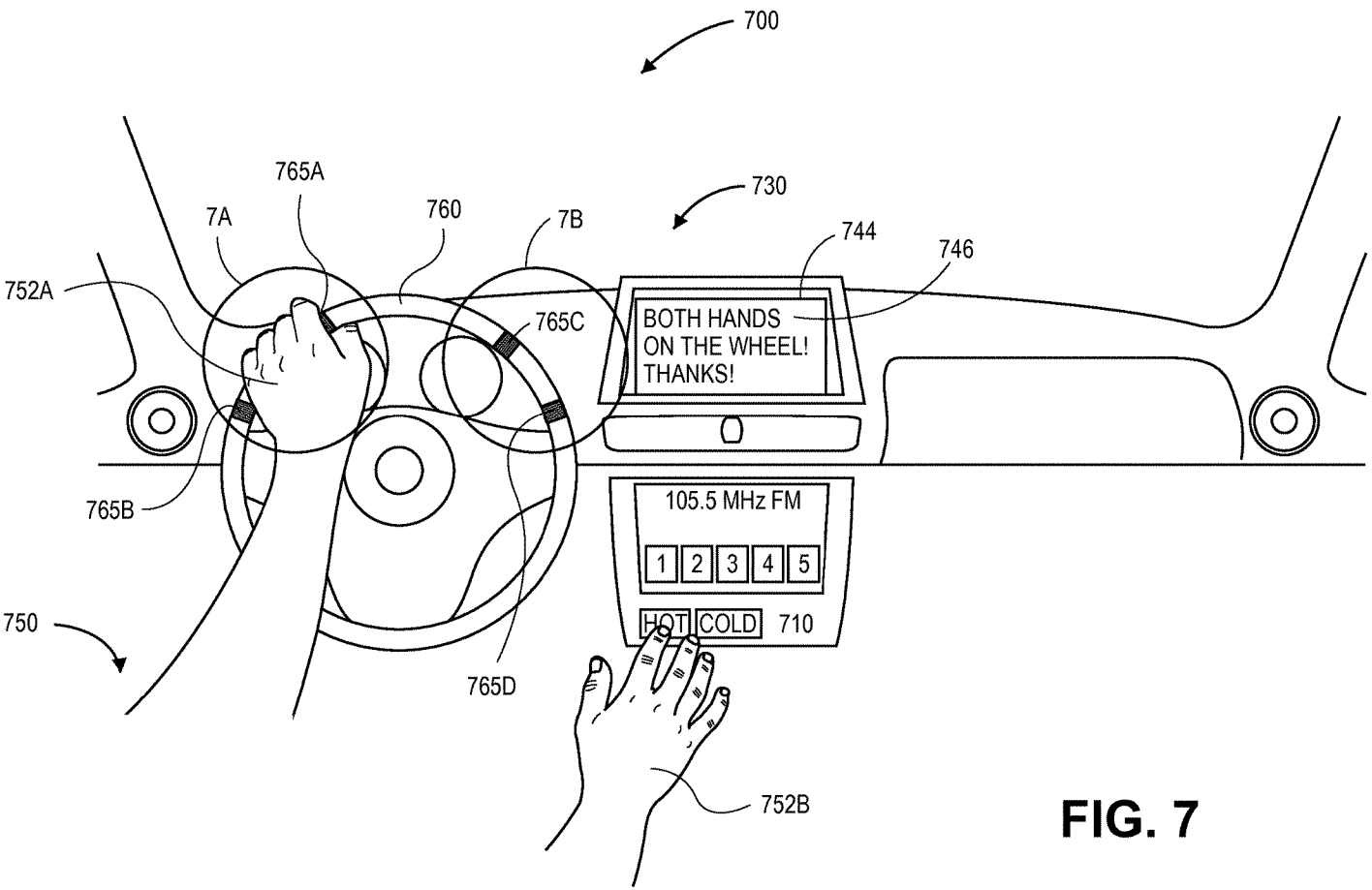
FIG. 7 is a view of one system for monitoring safety compliance based on RFID signals, in accordance with embodiments of the present disclosure.

Referring to FIG. 7, a system 700 for monitoring safety compliance based on RFID signals includes an automobile 730, a dashboard display screen 744, a steering wheel 760 with a plurality of manually activated RFID tags 765A, 765B, 765C, 765D disposed at various angular orientations about a circumference thereof. The automobile 730 is operated by a driver 750. Except where otherwise noted, reference numerals preceded by the number "7" in FIG. 7 indicate components or features that are similar to components or features having reference numerals preceded by the number "6" shown in FIG. 6, by the number "5" shown in FIG. 5, by the number "4" shown in FIG. 4, by the number "2" shown in FIG. 2, or by the number "1" shown in FIG. 1.

In accordance with the present disclosure, the system 700 may be provided for the purpose of determining whether the driver 750 is operating the automobile 730 with both hands 752A, 752B on the steering wheel 760. As is shown at 7A in FIG. 7, the left hand 752A of the driver 750 is gripping the steering wheel 760, and contacting one or more of the manually activated RFID tags 765A, 765B on a left side of the steering wheel 760. However, as is also shown at 7B in FIG. 7, the right hand 752B of the driver 750 is not gripping the steering wheel 760, or either of the manually activated RFID tags 765C, 765D.

Therefore, in accordance with the systems and methods of the present disclosure, RFID signals from one or more of the manually activated RFID tags 765A, 765B may be provided to an RFID reader and/or computer device, which may be provided in the form of onboard computer hardware (not shown). Upon receiving such signals, one or more of the systems and methods disclosed herein may determine that only one hand (viz., the left hand 752A) of the driver 750 is contacting the steering wheel 760 at a time. Accordingly, feedback 746 in the form of a visual reminder that the driver 750 should operate the automobile 730 with two hands on the steering wheel 760 may be provided on the dashboard display screen 744. The feedback 746 may be displayed at a predetermined interval of time following a failure to properly grip the steering wheel 760, or following a predetermined number of failures to properly grip the steering wheel 760, based on any relevant factor including but not limited to an identity of the driver 750.

Additionally, as is discussed above, when information regarding a plurality of RFID signals from one or more manually activated RFID tags is received, one or more patterns of the human's contact with a grippable element with which such manually activated RFID tags are associated may be analyzed in order to identify the human, or to make a determination as to the human's compliance with one or more requirements, standards or regulations. For example, a vector may be generated based on patterns of contact with one or more manually activated RFID tags associated with a grippable element and associated with the human, or with any other relevant information or data associated with the contact, and the vector and any such information may be provided as inputs for the purpose of training one or more machine learning tools or systems. Subsequently, when a plurality of RFID signals are received based on contact with one or more manually activated RFID tags by a plurality of humans, one or more vectors may be generated based on such signals and provided along with any other relevant information to the trained machine learning tools or systems as inputs, and the RFID signals may be associated with one or more humans based on the outputs of such tools or systems.

Figure 8:
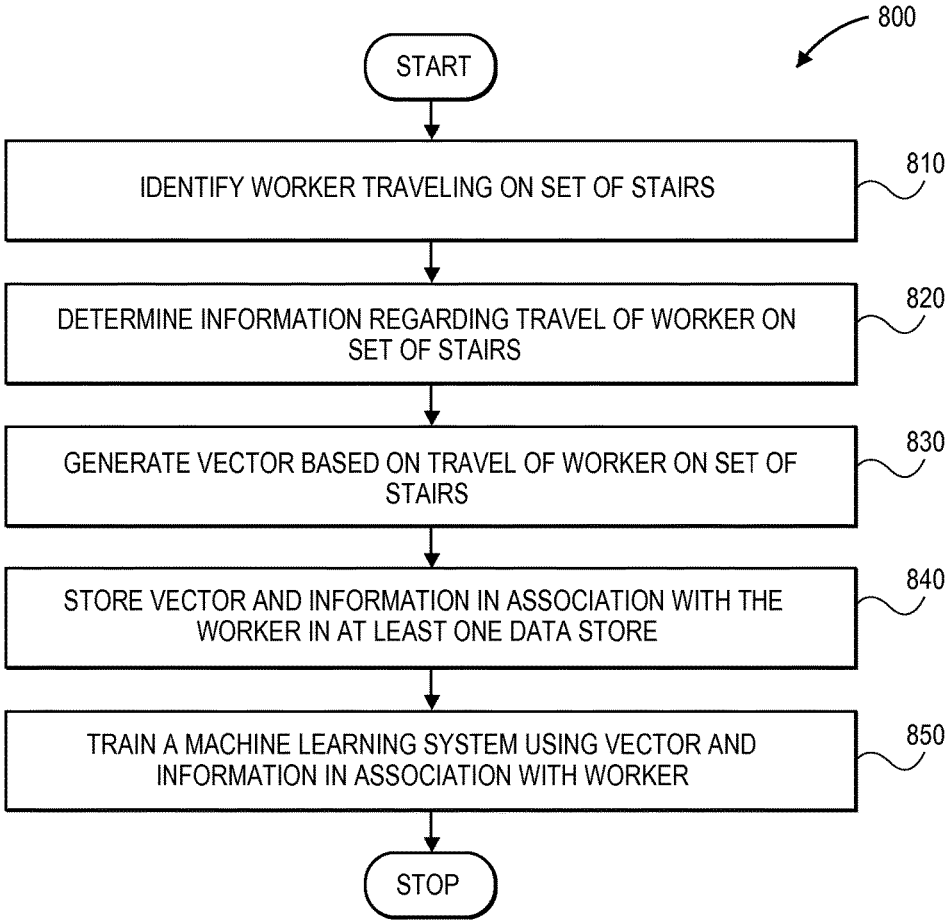
FIG. 8 is a flow chart of one process for monitoring safety compliance based on RFID signals, in accordance with embodiments of the present disclosure.

Referring to FIG. 8, a flow chart 800 representing one embodiment of a process for monitoring safety compliance based on RFID signals is shown. At box 810, a worker is identified as traveling on a set of stairs, and at box 820, information is obtained regarding the travel of the worker on the set of stairs. For example, the worker may be identified based on an RFID signal received from a passive RFID tag worn or carried by the worker, such as the identification badges 455A, 455B worn by the workers 450A, 450B of FIG. 4, or on any other relevant factor, and information or data such as the time or date at which the worker travels up or down the set of stairs, or the location of the set of stairs, may also be determined.

At box 830, a vector is generated based at least in part on the travel of the worker on the set of stairs. For example, the vector may be based on information regarding the worker's gait, which may vary based on whether the worker is traveling up or down the set of stairs, as well as the geometry of the specific set of stairs, or traffic in the form of the names or a number of other workers who are also traveling on the set of stairs at the time.

At box 840, the vector and the information are stored in association with the worker in at least one data store. At box 850, a machine learning system is trained using the vector and the information, and the process ends. For example, the vector generated at box 830 and the information determined at box 820 may be fed to one or more support vector machines, artificial neural networks or any like means or learning models for identifying traits or characteristics of the contact patterns based on the vector and the information, and associating such traits or characteristics with the worker.

Once a machine learning system has been trained to associate information regarding patterns of RFID signals sensed from multiple manually activated RFID tags with workers, the machine learning system may be utilized to capture RFID signals transmitted to an RFID reader following contact with a plurality of manually activated RFID tags by a plurality of workers, to define one or more vectors based at least in part on such RFID signals, to provide such vectors and any other relevant information to the trained machine learning system, and to associate one or more of the vectors with a given worker, thereby segregating a pattern of contact of the given worker from the various patterns of contacts of the other workers. By matching a vector defined based on patterns of contact with manually activated RFID tags with a given worker using a trained machine learning system, a level of compliance of the given worker with one or more requirements, standards or regulations may be isolated and determined, and customized feedback may be provided to the given worker individually.

Figure 9:
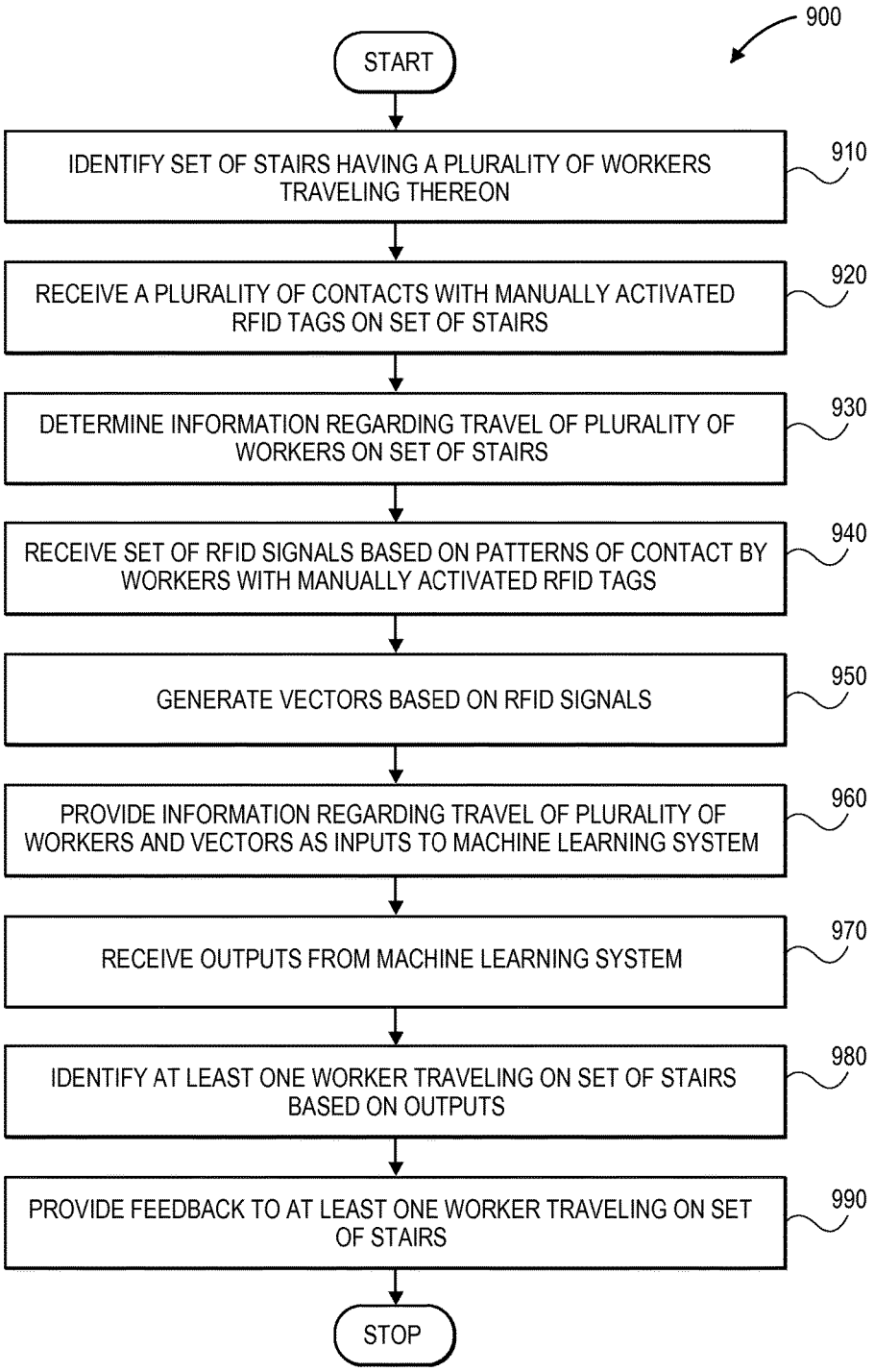
FIG. 9 is a flow chart of one process for monitoring safety compliance based on RFID signals, in accordance with embodiments of the present disclosure.

Referring to FIG. 9, a flow chart 900 representing one embodiment of a process for monitoring safety compliance based on RFID signals is shown. At box 910, a set of stairs having a plurality of workers traveling thereon is identified, and at box 920, a plurality of contacts with manually activated RFID tags on the set of stairs is received. For example, referring again to FIG. 1, the set of stairs 135 having the workers 150A, 150B, 150C traveling thereon may be identified, and contact with one or more of the manually activated RFID tags 165 on the handrail 160 may be received from the hands 152A, 152C of the workers 150A, 150C.

At box 930, information regarding the travel of the plurality of the workers on the set of stairs is determined, such as the identity of such workers, the time or the date of their travel, or any other relevant information. At box 940, a set of RFID signals based on the patterns of the contact by the workers with the manually activated RFID tags is received, e.g., by an RFID reader.

At box 950, vectors are generated based on the RFID signals. For example, a vector may be defined by the respective locations of the manually activated RFID tags contacted by the workers, as well as the times at which such tags were contacted. At box 960, the information regarding the travel of the workers on the set of stairs and the vectors are provided as inputs to a trained machine learning system. For example, a machine learning system may have been trained according to one or more processes, such as the process represented in the flow chart 800 of FIG. 8, to recognize one or more associations between vectors generated based on RFID signals and one or more workers, and may consider not only patterns of such contact but also other information relating to such contact.

At box 970, outputs from the trained machine learning system are received, and at box 980, at least one of the workers traveling on the set of stairs is identified based on the outputs. For example, the output may include a qualitative identification or prediction of the identity of a particular worker, or a quantitative assessment of the probability that a given vector corresponds to the particular worker. At box 990, feedback is provided to at least one of the workers traveling on the set of stairs, and the process ends. For example, where a pattern of contact is associated with a given worker, the pattern may be evaluated to determine whether the given worker has complied with any relevant requirements, standards or regulations, and appropriate feedback may be identified for the given worker and provided to the given worker by any known means or methods.

Figure 10A:
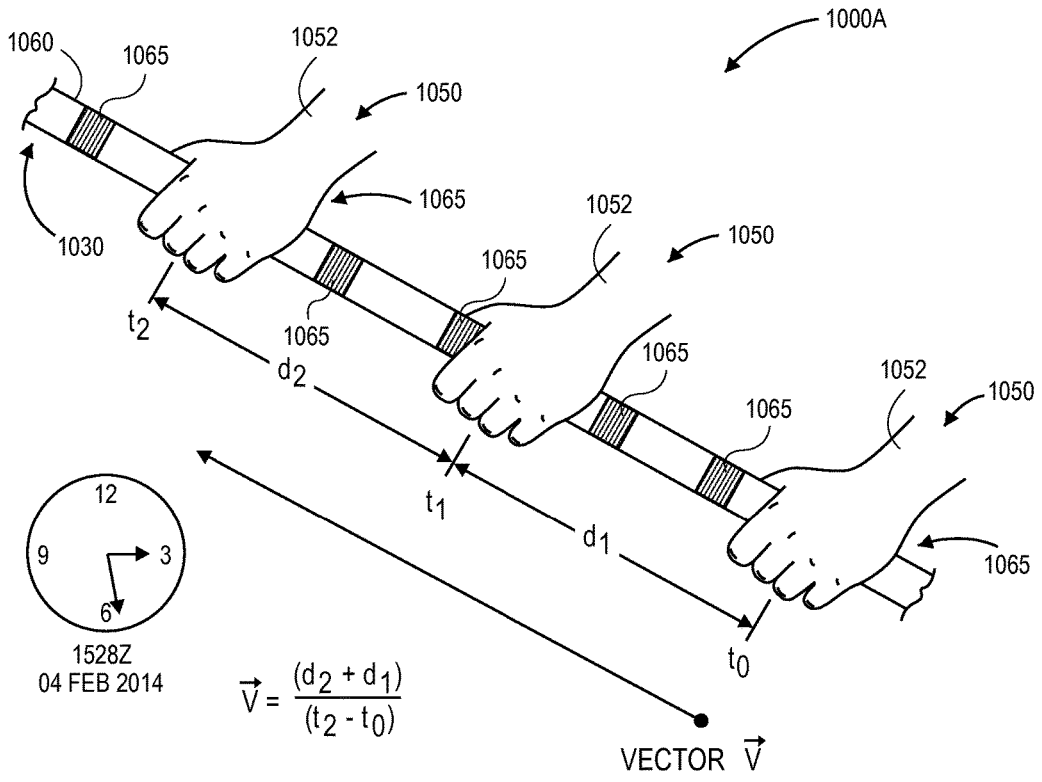
FIGS. 10A and 10B are views of components of one system for monitoring safety compliance based on RFID signals, in accordance with embodiments of the present disclosure.
Figure 10A:
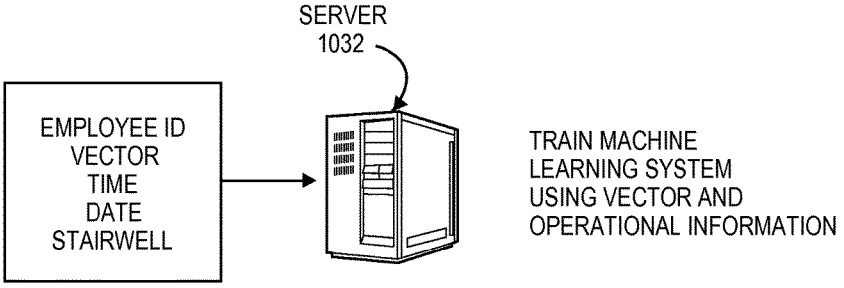
Figure 10B:
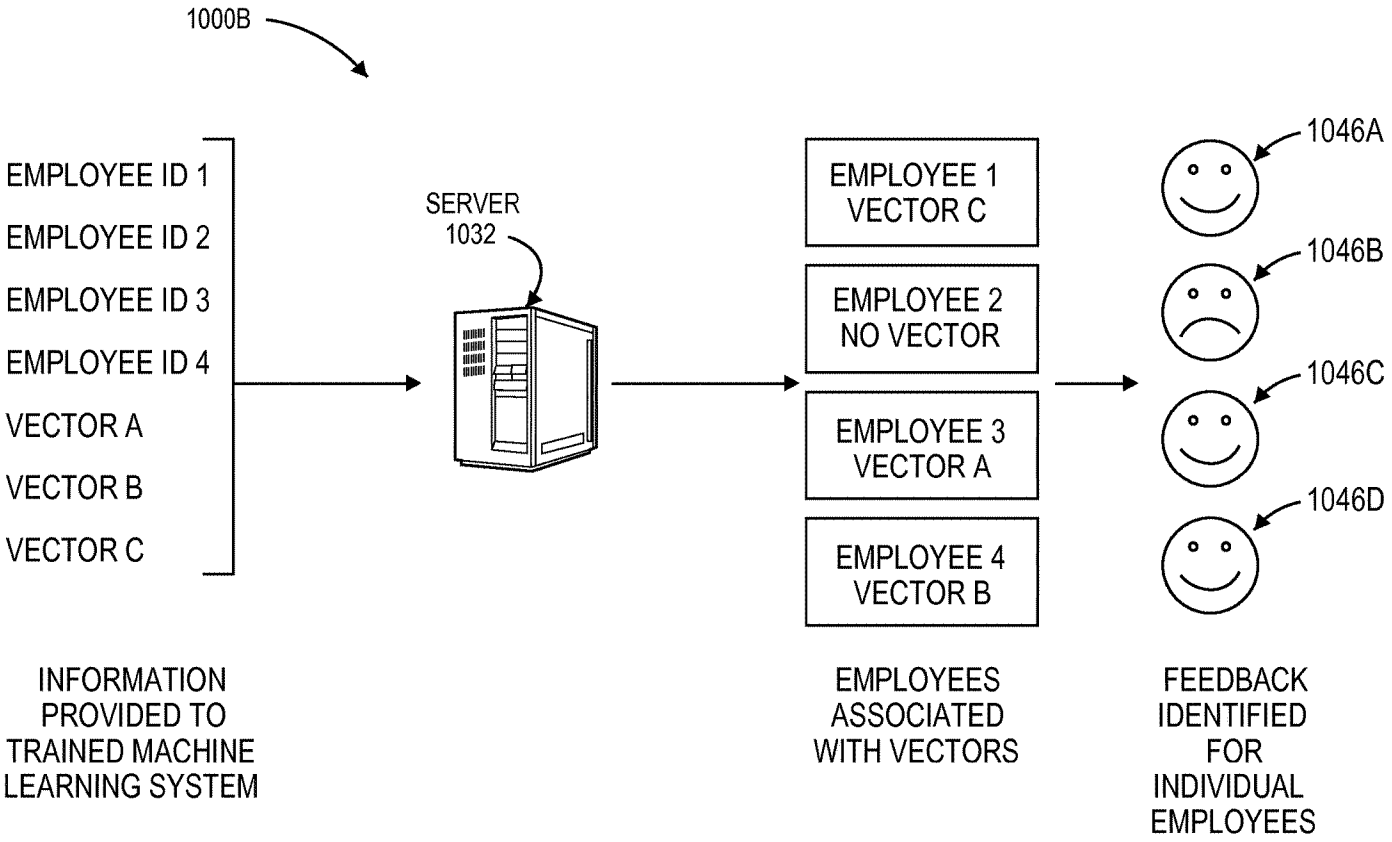

The generation of a vector based on contact with one or more manually activated RFID tags and the training of a machine learning system using the vector and any other relevant information is depicted in FIGS. 10A and 10B. Referring to FIG. 10A, a system 1000A including a handrail 1060 having a plurality of manually activated RFID tags 1065 disposed thereon is shown. Except where otherwise noted, reference numerals preceded by the number "10" in FIG. 10A or FIG. 10B indicate components or features that are similar to components or features having reference numerals preceded by the number "7" in FIG. 7, by the number "6" shown in FIG. 6, by the number "5" shown in FIG. 5, by the number "4" shown in FIG. 4, by the number "2" shown in FIG. 2, or by the number "1" shown in FIG. 1.

As is shown in FIG. 10A, a worker 1050 is contacting the handrail 1060 at various points with his or her hand 1052. In accordance with the present disclosure, a vector V may be defined based on the times and locations on the handrail 1060 that were contacted by the worker 1050. Subsequently, the vector V and any other relevant information, e.g., an identity of the worker 1050, a time and date of the contact, and a location of the handrail 1060 may be provided as inputs to a server 1032 operating a machine learning system, e.g., a support vector machine or an artificial neural network, for the purpose of training the machine learning system to recognize traits of the vector and the patterns of contact with the handrail 1060, and to associate such traits or patterns with one or more users.

Referring to FIG. 10B, a system 1000B includes a plurality of information regarding identities of workers on a set of stairs and vectors generated based on contact with manually activated RFID tags provided on a handrail associated with the set of stairs provided as inputs to a server operating a trained machine learning system. As is shown in FIG. 10B, the outputs from the server 1032 include associations of the workers with the vectors that were provided as inputs, indicating that patterns of contact were sensed from three of the workers, but not from a fourth worker. Accordingly, positive feedback 1046A, 1046C, 1046D may be provided to the workers who were determined to have made contact with the handrail 1060, while negative or constructive feedback 1046B may be provided to the worker who was determined to not have made contact with the handrail 1060.

Therefore, according to the systems and methods of the present disclosure, patterns of contact with a grippable element, such as the handrail 1060 of FIG. 10A, may be identified based on RFID signals received from one or more manually activated RFID tags, and isolated to one or more individual users using one or more machine learning tools or systems. Once a pattern of contact has been identified and associated with a given user, relevant feedback regarding the contact in relation with one or more relevant requirements, standards or regulations may be provided to the given user.

Although the disclosure has been described herein using exemplary techniques, components, and/or processes for implementing the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. For example, although some of the embodiments disclosed herein are shown as including manually activated RFID tags on handrails in fulfillment center environments, e.g., on objects, machines or structures within the fulfillment center, the systems and methods disclosed herein are not so limited, and may be provided in connection with any grippable element, such as the grippable elements 660A, 660B, 660C, 660D shown in FIG. 6 or the grippable element 760 shown in FIG. 7, for which information regarding contact with the grippable element is desired.

It should be understood that, unless otherwise explicitly or implicitly indicated herein, any of the features, characteristics, alternatives or modifications described regarding a particular embodiment herein may also be applied, used, or incorporated with any other embodiment described herein, and that the drawings and detailed description of the present disclosure are intended to cover all modifications, equivalents and alternatives to the various embodiments as defined by the appended claims. Moreover, with respect to the one or more methods or processes of the present disclosure described herein, including but not limited to the flow charts shown in FIGS. 3, 8 and 9, the order in which the boxes or steps of the methods or processes are listed is not intended to be construed as a limitation on the claimed inventions, and any number of the boxes or steps can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain embodiments could include, or have the potential to include, but do not mandate or require, certain features, elements and/or boxes or steps. In a similar manner, terms such as "include," "including" and "includes are generally intended to mean "including, but not limited to." Thus, such conditional language is not generally intended to imply that features, elements and/or boxes or steps are in any way required for one or more embodiments or that one or more embodiments necessarily include logic for deciding, with or without user input or prompting, whether these features, elements and/or boxes or steps are included or are to be performed in any particular embodiment.

Although the invention has been described and illustrated with respect to exemplary embodiments thereof, the foregoing and various other additions and omissions may be made therein and thereto without departing from the spirit and scope of the present disclosure.

What is claimed is:

1. A safety compliance system comprising:
- a handrail associated with a set of stairs;
- a plurality of manually activated radio-frequency identification (RFID) devices provided on the handrail;
- an RFID reader;
- a feedback device; and
- a computing device in communication with the RFID reader,
- wherein the computing device is configured to at least:
  - determine, by at least one of the RFID reader or the computing device, a first number of a plurality of workers traveling on the set of stairs;
  - identify a second number of RFID signals received at the RFID reader from at least one of the plurality of manually activated RFID devices;
  - determine whether the second number equals the first number;
  - upon determining that the second number does not equal the first number,
    - identify a first feedback message for at least one of the plurality of workers based at least in part on the second number of RFID signals; and
    - provide the first feedback message to the at least one of the plurality of workers by way of the feedback device.

2. The safety compliance system of claim 1, wherein the computing device is further configured to at least:
- upon determining that the second number equals the first number,
  - identify a second feedback message for the at least one of the plurality of workers based at least in part on the second number of RFID signals; and
  - provide the second feedback message to the at least one of the plurality of workers by way of the feedback device.

3. The safety compliance system of claim 1, wherein the computing device is further configured to at least:
- identify a third number of RFID signals received at the RFID reader from passive RFID devices associated with each of the plurality of workers,
- wherein the first number is determined based at least in part on the third number.

4. The safety compliance system of claim 1, wherein the first feedback message identifies a requirement to hold the handrail while traveling on the set of stairs.

5. A method comprising:
- receiving at least one signal from at least one manually activated radio-frequency identification (RFID) tag provided on at least one structural element related to an activity;
- determining a number of persons participating in the activity;

identifying a requirement associated with at least one of the at least one structural element or the activity;

determining a number of the persons complying with the requirement based at least in part on the at least one signal from the at least one manually activated RFID tag provided on the at least one structural element related to the activity; and determining a level of compliance with the requirement based at least in part on the number of the persons participating in the activity and the number of the persons complying with the requirement.

6. The method of claim 5, wherein the at least one structural element is at least one of:

a handrail;

a handlebar;

a steering wheel for operating a motor vehicle; or a handle of a tool.

7. The method of claim 5, wherein the at least one structural element comprises a plurality of manually activated RFID tags in a defined spatial relationship.

8. The method of claim 5, wherein the at least one signal is received following a manual activation of the at least one manually activated RFID tag at a first time.

9. The method of claim 8, wherein the at least one manually activated RFID tag comprises an open circuit having at least two capacitive elements separated by an air gap, and wherein the manual activation closes the open circuit at the first time.

10. The method of claim 5, wherein determining the level of compliance with the requirement comprises:

defining a vector of contact with the at least one structural element based at least in part on the at least one signal; and associating the vector of contact with at least one of the number of persons participating in the activity.

11. The method of claim 5, wherein the activity comprises at least one of ascending a set of stairs or descending the set of stairs, and wherein the requirement is an obligation of at least one of the number of persons participating in the activity to hold the at least one structural element while ascending the set of stairs or while descending the set of stairs.

12. The method of claim 5, wherein determining the number of the persons participating in the activity comprises:

receiving a plurality of signals from RFID tags assigned to each of the number of persons participating in the activity; and counting a number of the plurality of signals received from the RFID tags.

13. The method of claim 5, further comprising:

identifying feedback relating to the activity based at least in part on the level of compliance with the requirement; and providing the feedback to at least one of the number of persons participating in the activity on at least one feedback device.

14. The method of claim 13, wherein the feedback comprises an electronic message, and wherein providing the feedback to the at least one of the number of persons participating in the activity comprises at least one of:

providing the electronic message to the at least one of the number of persons participating in the activity by way of the feedback device; or causing a display of at least some of the electronic message on the feedback device.

15. The method of claim 13, wherein the feedback comprises an audio signal, and wherein providing the feedback to the at least one of the number of persons participating in the activity comprises:

playing at least some of the audio signal on the feedback device.

16. The method of claim 13, wherein the feedback is ambient feedback comprising at least one of a predetermined light or a predetermined sound, and wherein providing the feedback to the at least one of the number of persons participating in the activity comprises at least one of illuminating the predetermined light or playing the predetermined sound.

17. A non-transitory computer-readable medium having computer-executable instructions stored thereon, wherein the instructions, when executed, cause a computer system having at least one computer processor to perform a method comprising:

determining that at least a first worker and a second worker are contacting at least a portion of a grippable element;

identifying a first plurality of radio-frequency identification (RFD)) signals received from manually activated RFID tags disposed on the grippable element, wherein each of the first plurality of RFID signals is transmitted upon contact with at least the portion of the grippable element by one of the first worker or the second worker;

defining a first pattern of contact based at least in part on the first plurality of RFID signals;

generating at least a first vector based at least in part on the first pattern of contact;

determining first information regarding the contact with at least the portion of the grippable element by the one of the first worker or the second worker;

providing at least the first vector and at least some of the first information regarding the contact with at least the portion of the grippable element to a machine learning system as inputs;

receiving at least one output from the machine learning system; and identifying the first worker based at least in part on the at least one output.

18. The non-transitory computer-readable medium of claim 17, wherein the method further comprises:

identifying a second plurality of RFID signals received from the manually activated RFID tags disposed on the grippable element, wherein each of the second plurality of RFID signals is transmitted upon contact with at least the portion of the grippable element by the second worker;

defining a second pattern of contact based at least in part on the second plurality of RFID signals;

generating at least a second vector based at least in part on the second pattern of contact;

determining second information regarding the contact with at least the portion of the grippable element by the second worker, wherein the second information regarding the contact comprises an identity of the second worker; and training the machine learning system to recognize the identity of the second worker based at least in part on the second vector.

19. The non-transitory computer-readable medium of claim 18, wherein the method further comprises:

determining whether the second worker complied with a requirement associated with the grippable element based at least in part on the second pattern of contact;

upon determining that the second worker did not comply with the requirement, providing feedback to the second worker by way of at least one feedback device.

* * * * *